US012215450B2

(12) United States Patent
Mori

(10) Patent No.: US 12,215,450 B2
(45) Date of Patent: Feb. 4, 2025

(54) SEWING MACHINE PROVIDED WITH ADJUSTING MECHANISM ADJUSTING PRESSING FORCE APPLIED TO WORKPIECE

(71) Applicant: BROTHER KOGYO KABUSHIKI KAISHA, Nagoya (JP)

(72) Inventor: Hiroki Mori, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 30 days.

(21) Appl. No.: 18/343,440

(22) Filed: Jun. 28, 2023

(65) Prior Publication Data

US 2023/0416960 A1 Dec. 28, 2023

(51) Int. Cl.
*D05B 29/12* (2006.01)
*D05B 29/08* (2006.01)

(52) U.S. Cl.
CPC ..... *D05B 29/12* (2013.01); *D05B 29/08* (2013.01)

(58) Field of Classification Search
CPC ..... E05B 29/00; E05B 29/12
See application file for complete search history.

(56) References Cited

U.S. PATENT DOCUMENTS 2,012,157 A * 8/1935 Corson ..... D05B 29/02 112/236
3,294,047 A * 12/1966 Graham ..... D05B 29/02 112/235
3,303,804 A * 2/1967 Lesort ..... D05B 29/02 112/235
3,329,115 A * 7/1967 Heinrich ..... D05B 29/02 112/235
3,863,580 A * 2/1975 Marforio ..... D05B 29/02 112/235
4,058,071 A * 11/1977 Dunn ..... D05B 29/02 112/235

(Continued)

FOREIGN PATENT DOCUMENTS

EP 1 990 454 A1 11/2008
JP S56-35379 U 4/1981

(Continued)

OTHER PUBLICATIONS

Oct. 18, 2023 extended Search Report issued in European Patent Application No. 23181872.5.

*Primary Examiner* — Ismael Izaguirre
(74) *Attorney, Agent, or Firm* — Oliff PLC

(57) ABSTRACT

In a sewing machine, a feed dog feeds a workpiece placed on a throat plate. A presser bar has a lower end portion on which a presser foot is mountable. A presser bar spring urges the presser bar downward. During a first prescribed period of time in which a top of the feed dog is above a top surface of the throat plate, an adjustment part of an adjusting mechanism is spaced apart from a restricting part of the adjusting mechanism to cause an urging force of the presser bar spring to be transmitted to the presser foot. During a second prescribed period of time in which the top of the feed dog is beneath the top surface of the throat plate, the adjustment part is in contact with the restricting part to prevent the urging force of the presser bar spring from being transmitted to the presser foot.

8 Claims, 13 Drawing Sheets

(56) References Cited

U.S. PATENT DOCUMENTS

| | | | | | |
|---|---|---|---|---|---|
| 4,342,272 | A * | 8/1982 | Transue | D05B 29/02 | 112/237 |
| 5,461,997 | A * | 10/1995 | Landen | D05B 29/02 | 112/237 |
| 5,590,614 | A | 1/1997 | Murata et al. | | |
| 6,415,725 | B1 * | 7/2002 | Yoshikazu | D05B 29/02 | 112/237 |
| 2009/0277366 | A1 * | 11/2009 | Tseng | D05B 29/12 | 112/235 |

FOREIGN PATENT DOCUMENTS

| | | | |
|---|---|---|---|
| JP | 2001-187288 | A | 7/2001 |
| JP | 3198818 | U | 7/2015 |
| JP | 2016-137027 | A | 8/2016 |
| JP | 2019-130121 | A | 8/2019 |
| JP | 2019-162284 | A | 9/2019 |

* cited by examiner

SEWING MACHINE PROVIDED WITH ADJUSTING MECHANISM ADJUSTING PRESSING FORCE APPLIED TO WORKPIECE

REFERENCE TO RELATED APPLICATIONS

This application claims priority from Japanese Patent Application No. 2022-103573 filed on Jun. 28, 2022. The entire content of the priority application is incorporated herein by reference.

BACKGROUND ART

A pressing device in a conventional sewing machine includes connecting members, a moving member, and an elastic member. The connecting members are connected to and pivotally move relative to a spindle of the sewing machine. The moving member moves in the up-down direction as the connecting members pivotally move. The elastic member is disposed between the moving member and a presser bar that applies an elastic force to the presser bar. The elastic force applied by the elastic member is changed by movement of the moving member. The pressing device changes the urging force applied to a presser foot provided on the lower end of the presser bar in association with the spindle of the sewing machine by moving the moving member so that the urging force of the elastic member is greater when the feed dog is raised above the throat plate than when the feed dog is positioned below the throat plate.

DESCRIPTION

However, the pressing device in the conventional sewing machine described above requires a complex configuration for changing the pressing force applied by the presser foot to the workpiece.

In view of the foregoing, it is an object of the present invention to provide a sewing machine having a simpler configuration for changing the pressing force that the presser foot applies to a workpiece.

(1) In order to attain the above and other object, according to one aspect, the present disclosure provides a sewing machine. The sewing machine includes: a sewing machine motor; a needle bar; a throat plate; a feed dog; a feed mechanism; a presser bar; a presser bar spring; an adjustment spring; a presser bar clamp; and an adjusting mechanism. The needle bar extends in an up-down direction. The needle bar has a lower end portion on which a needle is mountable. The needle bar is configured to be driven by the sewing machine motor to move in the up-down direction. The throat plate is formed with a needle hole and an opening. The needle is configured to pass through the needle hole in accordance with movement of the needle bar in the up-down direction. The feed dog is configured to emerge from and be retracted beneath the opening. The feed dog is configured to feed a workpiece placed on the throat plate. The feed mechanism is configured to be driven by the sewing machine motor to drive the feed dog. The presser bar extends in the up-down direction. The presser bar has a lower end portion on which a presser foot is mountable. The presser bar is configured to move in the up-down direction in synchronization with movement of the feed dog. The presser bar spring has an upper end and a lower end in the up-down direction. The presser bar spring is configured to urge the presser bar downward with an urging force. The adjustment spring has an upper end and a lower end in the up-down direction. The adjustment spring is configured to urge the presser bar downward with an urging force smaller than the urging force of the presser bar spring. The presser bar clamp is fixed to the presser bar. The presser bar clamp is configured to define a position of the lower end of the adjustment spring in the up-down direction. The adjusting mechanism includes: an adjustment part; and a restricting part. The adjustment part is supported to be movable in the up-down direction. The adjustment part is configured to define a position of the lower end of the presser bar spring in the up-down direction and a position of the upper end of the adjustment spring in the up-down direction. The restricting part is configured to restrict a moving range f the adjustment part in the up-down direction when the restricting part contacts the adjustment part. During a first prescribed period of time in which a top of the feed dog is above a top surface of the throat plate, the adjustment part is spaced apart from the restricting part in the up-down direction to cause the urging force of the presser bar spring to be transmitted to the presser foot. During a second prescribed period of time in which the top of the feed dog is beneath the top surface of the throat plate, the adjustment part is in contact with the restricting part in the up-down direction to prevent the urging force of the presser bar spring from being transmitted to the presser foot.

With the configuration according to the aspect (1), the adjusting mechanism of the sewing machine can switch whether the urging force of the presser bar spring is transmitted to the presser foot or not according to the position of the feed dog in the up-down direction. Thus, the adjusting mechanism of the sewing machine helps to change the amount of the pressing force applied by the presser foot to the workpiece through a simpler configuration than the conventional sewing machine.

Figure 9:
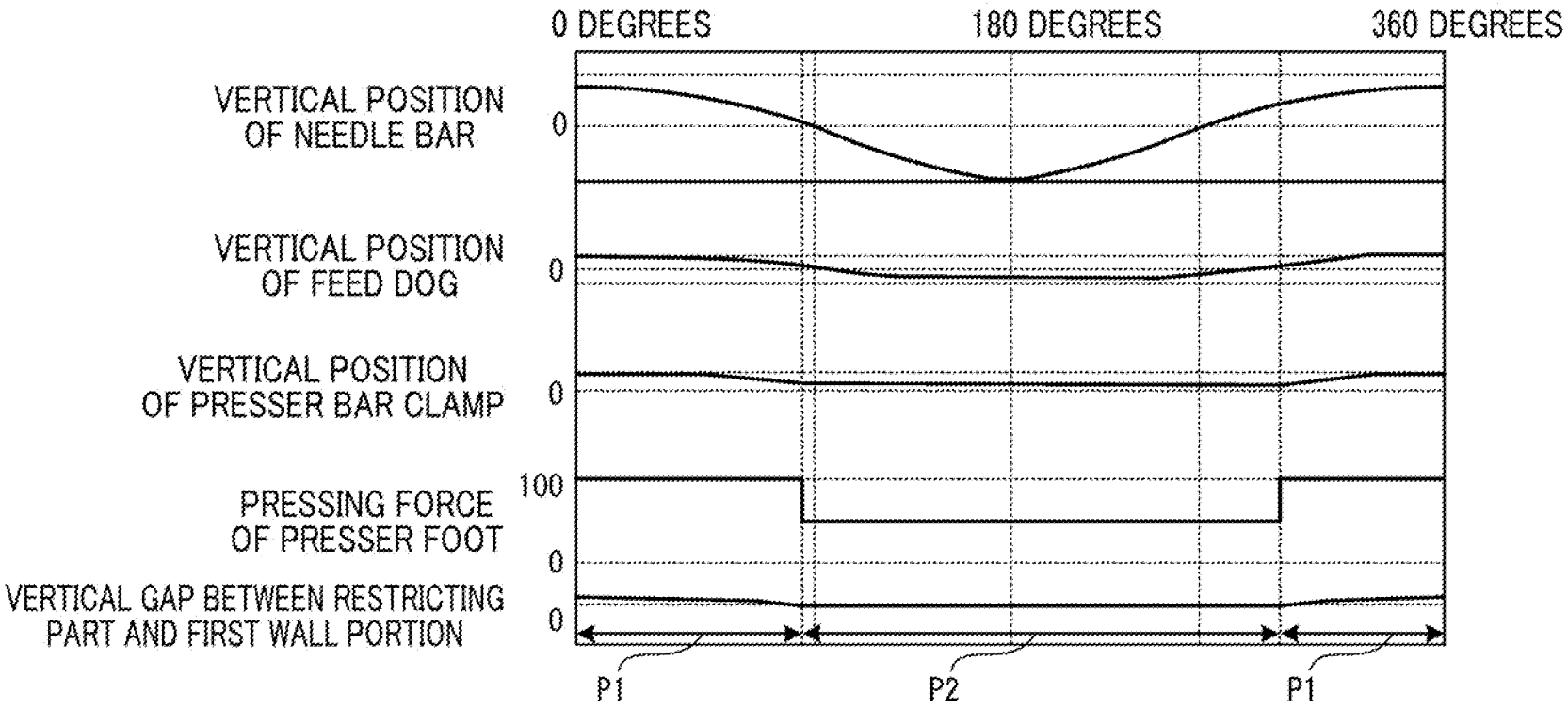

FIG. 9 is an explanatory diagram illustrating a position of a needle bar in the up-down direction, a position of a feeding dog in the up-down direction, a position of the presser bar clamp in the up-down direction, a pressure force applied by a presser foot to a workpiece, and a gap between the restricting part and the first wall portion of the adjustment part in the up-down direction as the rotated angle of a sewing machine motor changes in the sewing machine.

Figure 10:
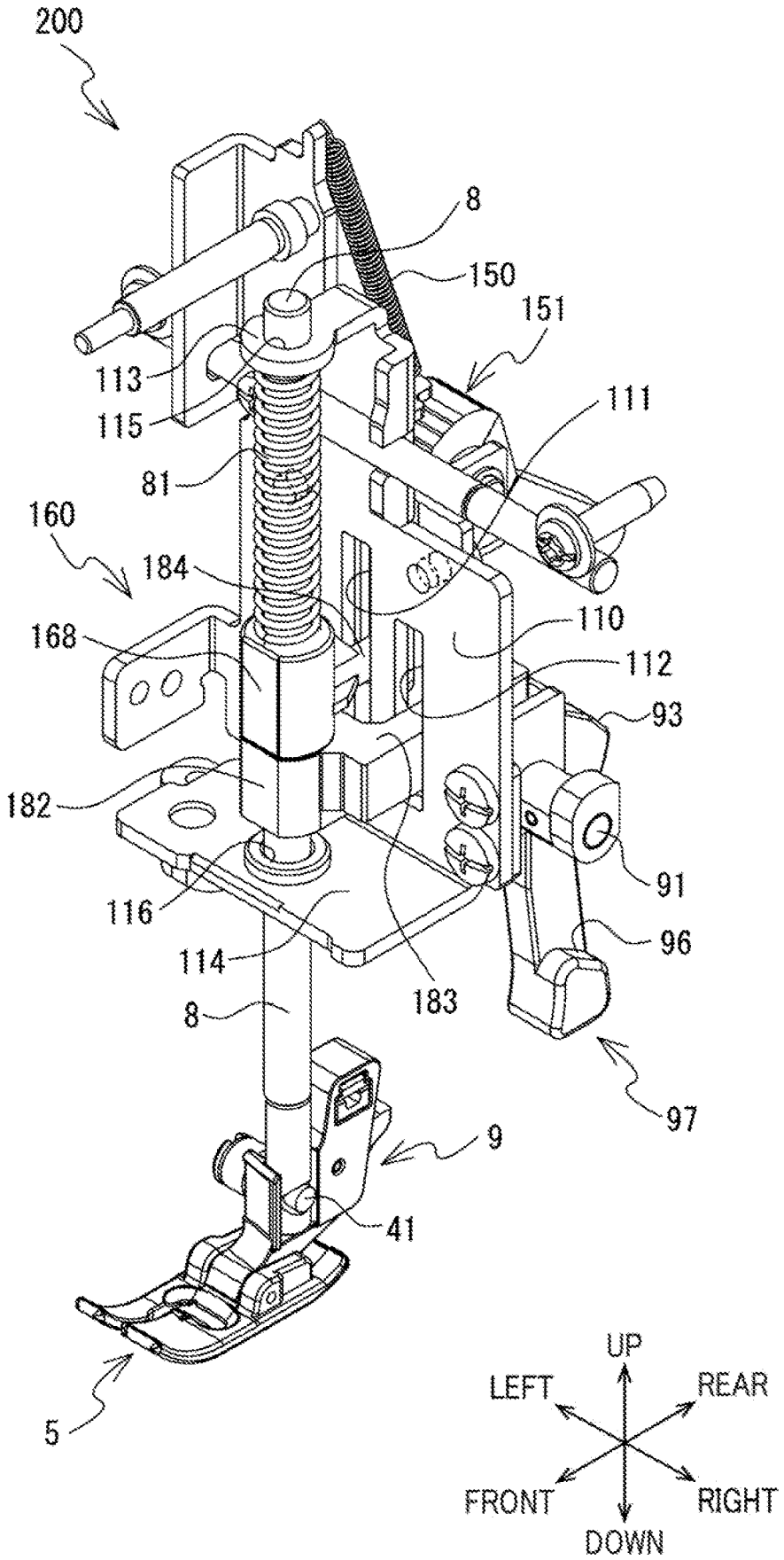

FIG. 10 illustrates a perspective view of a presser bar, a presser bar clamp, and an adjusting mechanism of a sewing machine according to a variation on which a presser foot is mounted.

Figure 11:
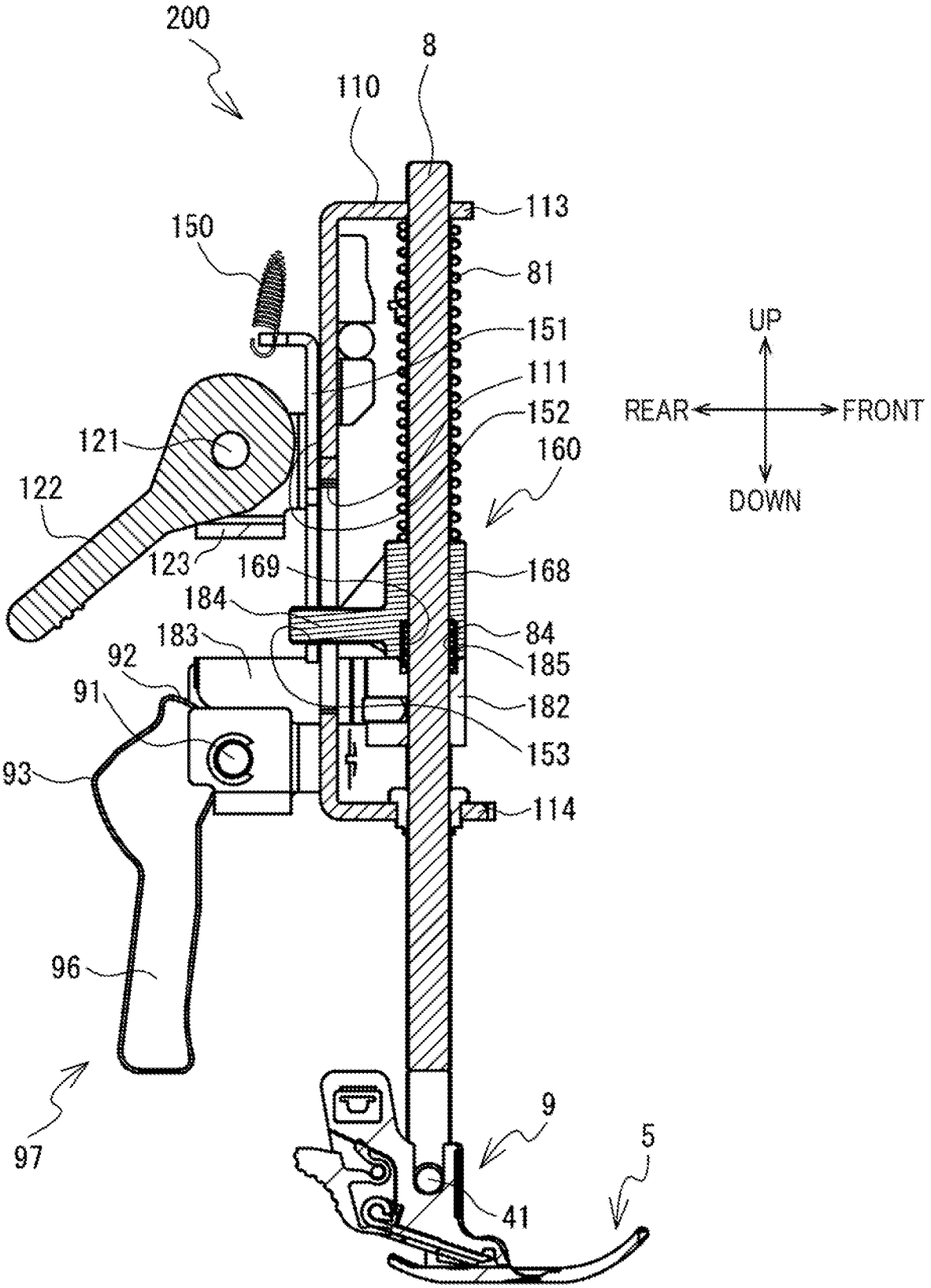

FIG. 11 illustrates a cross-sectional view of the presser bar, presser bar clamp, and adjusting mechanism of the sewing machine on which the presser foot is mounted in an unlocked state in which a connecting part of an adjustment part of the adjusting mechanism is spaced apart from a restricting part of the adjusting mechanism in the up-down direction.

Figure 12:
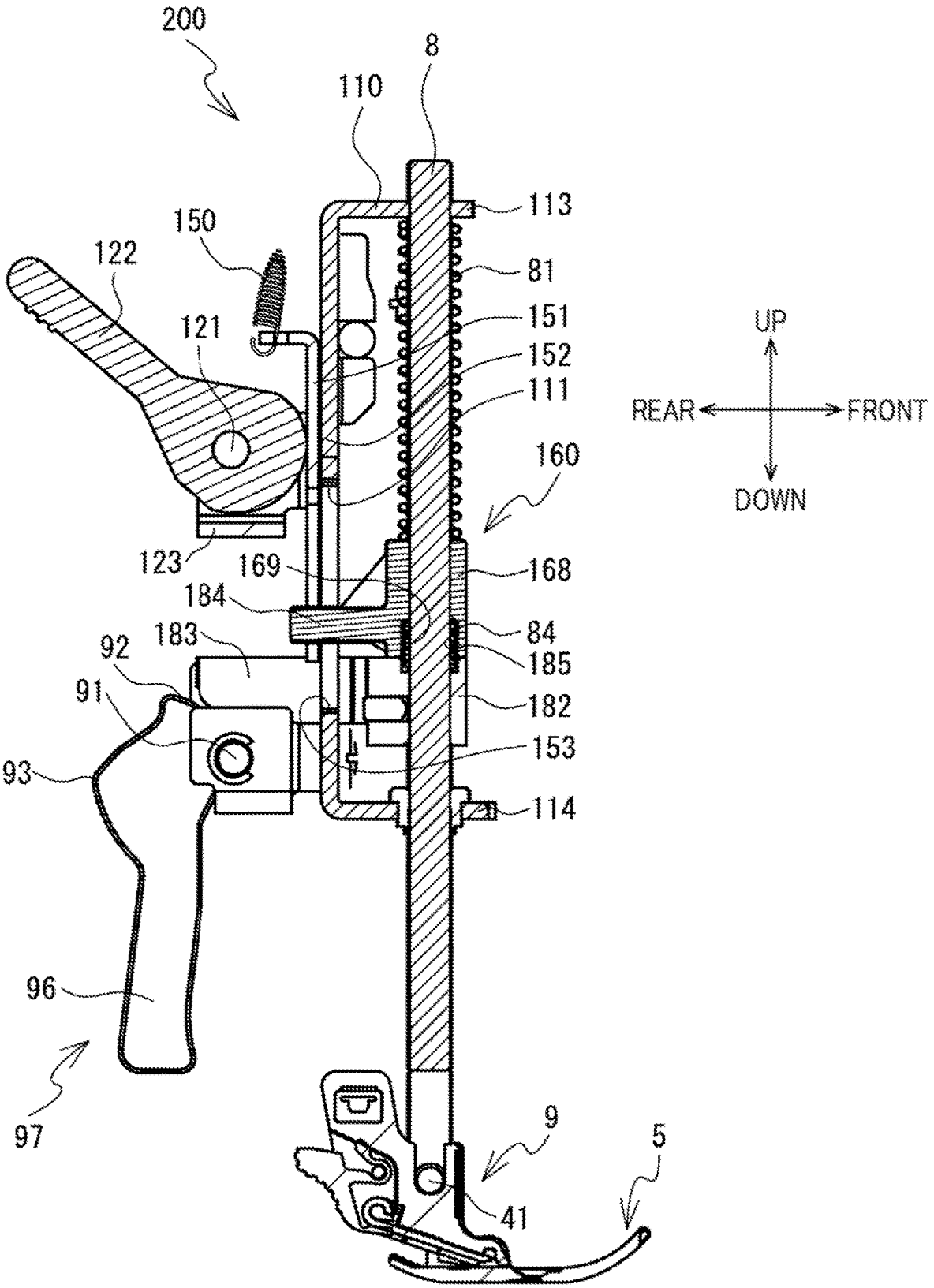

FIG. 12 illustrates a cross-sectional view of the presser bar, presser bar clamp, and adjusting mechanism of the sewing machine on which the presser foot is mounted in a locked state in which the connecting part of the adjustment part of the adjusting mechanism is in contact with the restricting part of the adjusting mechanism in the up-down direction.

Figure 13:
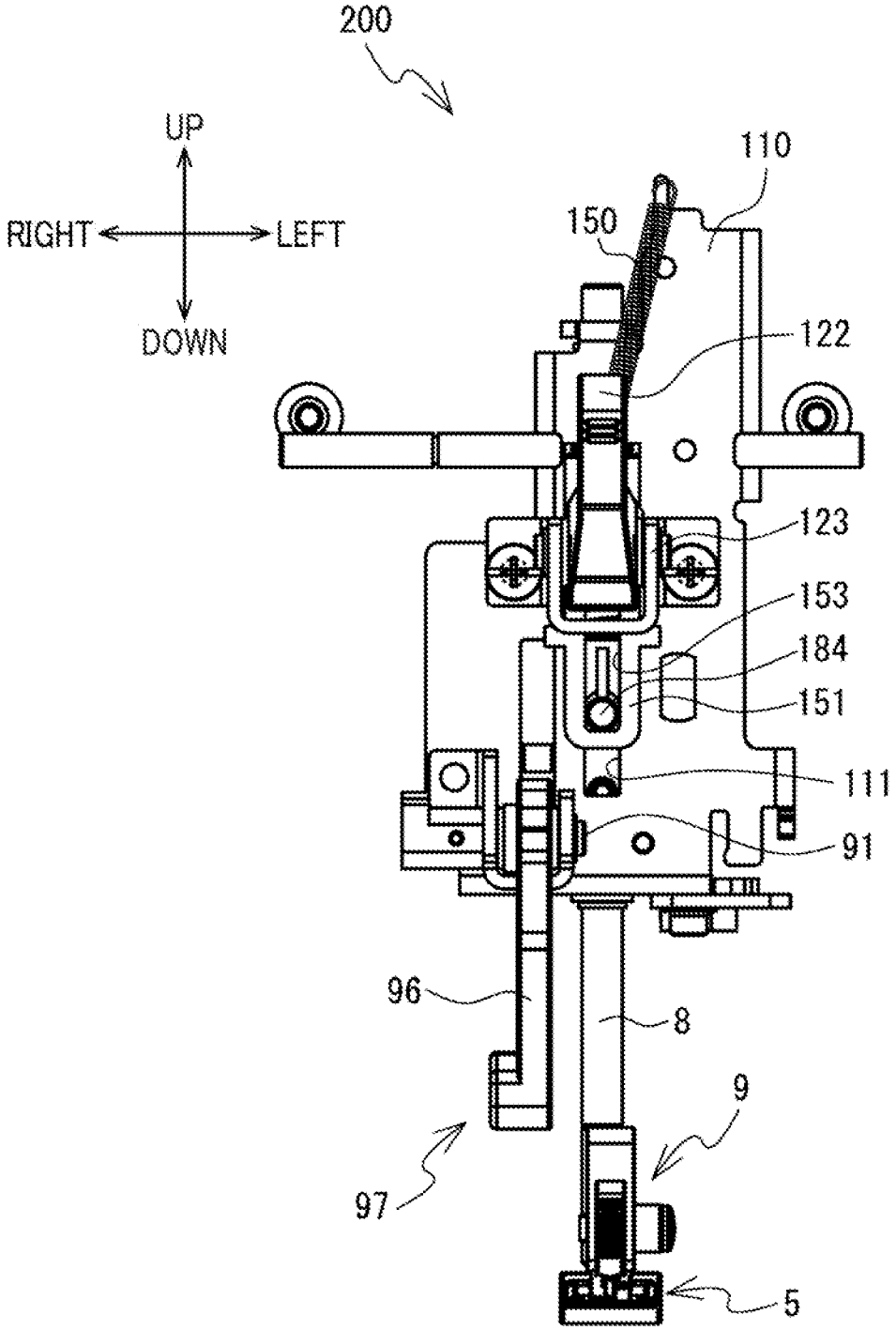

FIG. 13 illustrates a rear view of the presser bar and adjusting mechanism of the sewing machine on which the presser foot is mounted.

Next, an embodiment of the present disclosure will be described while referring to the accompanying drawings. The physical configuration of a sewing machine 1 will be described with reference to FIGS. 1 and 2. The sewing machine 1 of the present embodiment has functions for facilitating curved line sewing by mechanically changing a pressing force applied to a presser foot 5 at prescribed timings as a needle bar 31 of the sewing machine 1 reciprocates in the up-down direction (i.e., moves upward and downward). The sewing machine 1 is configured to easily switch the pressing force applied to the presser foot 5 between a force suitable for curved line sewing and a force suitable for normal sewing. Directions upward, downward, toward the lower-right, toward the upper-left, toward the lower-left, and toward the upper-right in FIG. 1 will indicate the top, bottom, right, left, front, and rear sides of the sewing machine 1 in which a pressing device 9 is mounted. The longitudinal directions of a bed section 11 and an arm section 13 are aligned with the left-right direction of the sewing machine 1. The side of the sewing machine 1 in which a column section 12 is arranged constitutes the right side of the sewing machine 1. The direction in which the column section 12 extends is the up-down direction relative to the sewing machine 1.

Figure 1:
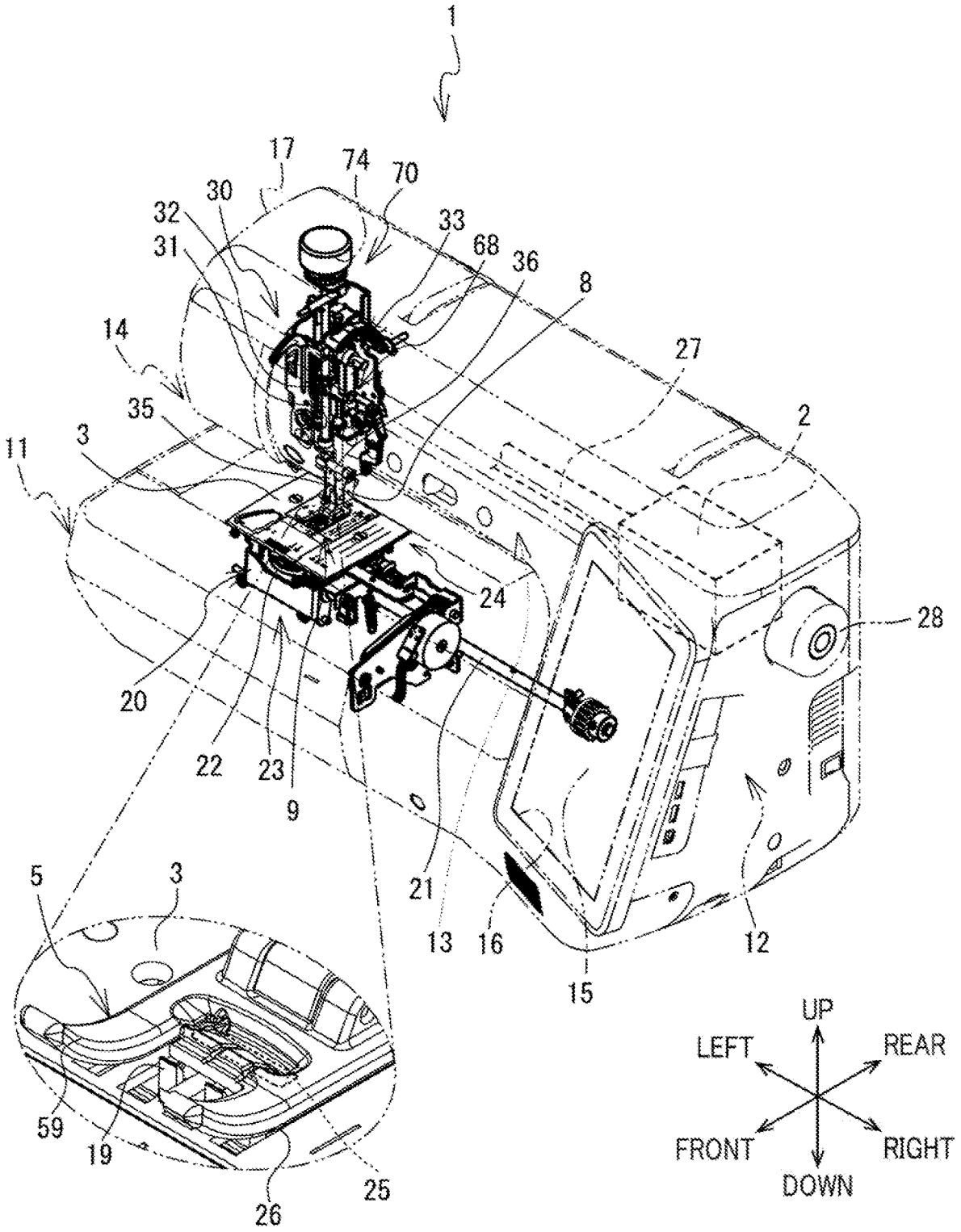
FIG. 1 illustrates a perspective view of a sewing machine on which a presser foot is mounted.

As illustrated in FIG. 1, the sewing machine 1 includes the bed section 11, the column section 12, the arm section 13, and a head section 14. As illustrated in FIG. 1, a cover 17 covers the bed section 11, column section 12, arm section 13, and head section 14. The bed section 11 is the base portion of the sewing machine 1 that extends in the left-right direction. The bed section 11 includes a throat plate 3 provided on the top surface thereof. Beneath the throat plate 3, the bed section 11 includes a rotary hook mechanism 20, a feed dog 19, a feed mechanism 23, and a feed dog drop mechanism 24. The rotary hook mechanism 20 includes a lower shaft 21, and a horizontal rotary hook 22. The horizontal rotary hook 22 rotates along with the rotation of the lower shaft 21 to loop a needle thread (not illustrated) around a bobbin thread (not illustrated) beneath the throat plate 3. The throat plate 3 has a plate-like shape that extends horizontally. The throat plate 3 is formed with a needle hole 25 through which a needle 35 described below passes, and slits 26 extending in the front-rear direction.

The feed dog 19 retractably emerges from the slits 26 formed in the throat plate 3 for feeding a workpiece placed on the throat plate 3 (not illustrated). When driven by a sewing machine motor 2 described below, the feed mechanism 23 drives the feed dog 19 to convey the workpiece rearward or forward. The feed dog drop mechanism 24 is configured to move only the feed dog 19 below the throat plate 3 independently from the drive of the sewing machine motor 2. The user operates a touchscreen 16 described below to input instructions for moving the feed dog 19 to a prescribed position with the feed dog drop mechanism 24. On the basis of these instructions, the sewing machine 1 can control a drive force of the feed dog drop mechanism 24 to change the position of the feed dog 19 independently from the drive of the sewing machine motor 2. The feed dog drop mechanism 24 may also change the position of the feed dog 19 independently from the drive of the sewing machine motor 2 when a lever disposed on the rear of the sewing machine 1 is operated.

The column section 12 is erected upward from the right end portion of the bed section 11. The sewing machine motor 2 is provided inside the upper portion of the column section 12. A liquid crystal display (LCD) 15 is provided on the front surface of the column section 12. The touchscreen 16 is provided over the front surface of the LCD 15. A pulley 28 is provided on the right surface of the column section 12.

The arm section 13 extends leftward from the upper end of the column section 12 parallel to the bed section 11. The head section 14 is coupled with the left end of the arm section 13. Provided in the head section 14 are a needle bar 31, a needle bar mechanism 30, a presser bar 8, an adjusting mechanism 68, a changing member 70, and the like. A needle clamp 36 is fixed to the lower end portion of the needle bar 31. The needle 35 is detachably fixed by the needle clamp 36. The needle 35 can be mounted on the lower end portion of the needle bar 31 via the needle clamp 36.

The needle bar mechanism 30 includes the sewing machine motor 2, a spindle 27, a link mechanism 33, and a needle bar clamp 32. The spindle 27 rotates in response to the drive of the sewing machine motor 2 to transmit the drive of the sewing machine motor 2 to the needle bar 31 via the link mechanism 33 and needle bar clamp 32. The needle bar clamp 32 is fixed to the needle bar 31. The needle bar mechanism 30 moves the needle bar 31 in the up-down direction in response to the drive of the sewing machine motor 2. The spindle 27 also rotates when the user rotates the pulley 28.

Figure 2A:
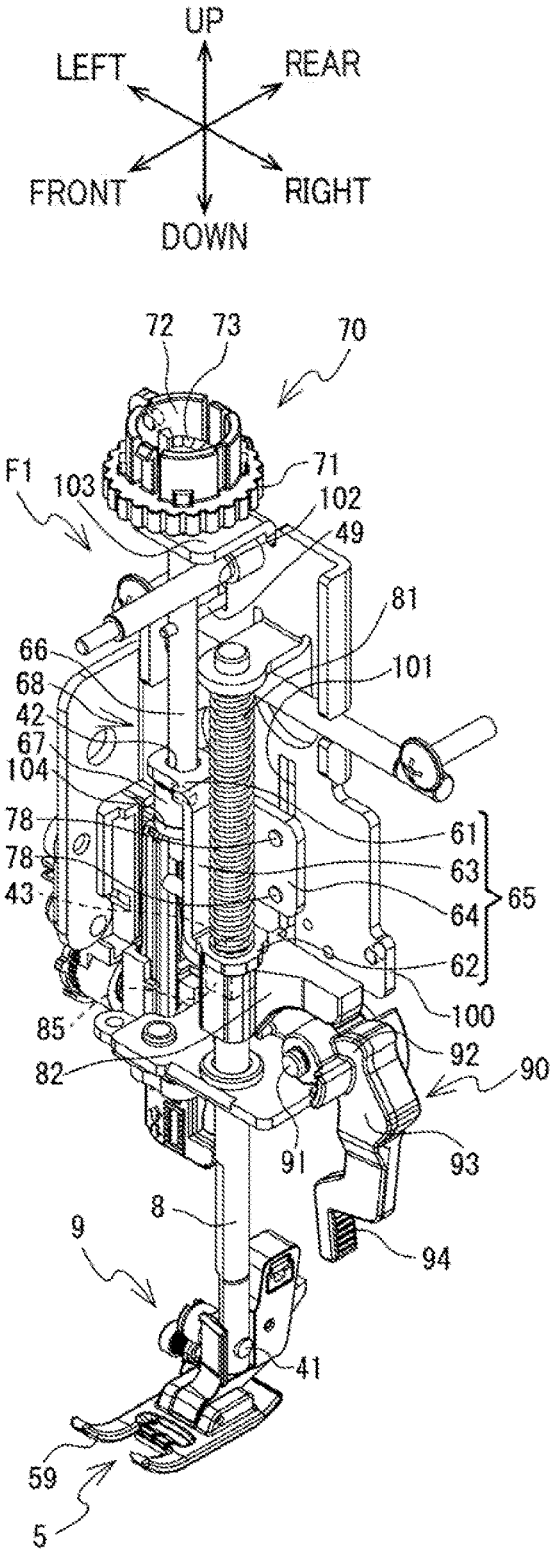
FIG. 2A illustrates a perspective view of a presser bar, a presser bar clamp, an adjusting mechanism, and a changing member of the sewing machine on which the presser foot is mounted in state F1 in which a first wall portion of an adjustment part of the adjusting mechanism is in contact with a restricting part of the adjusting mechanism in an up-down direction.
Figure 2B:
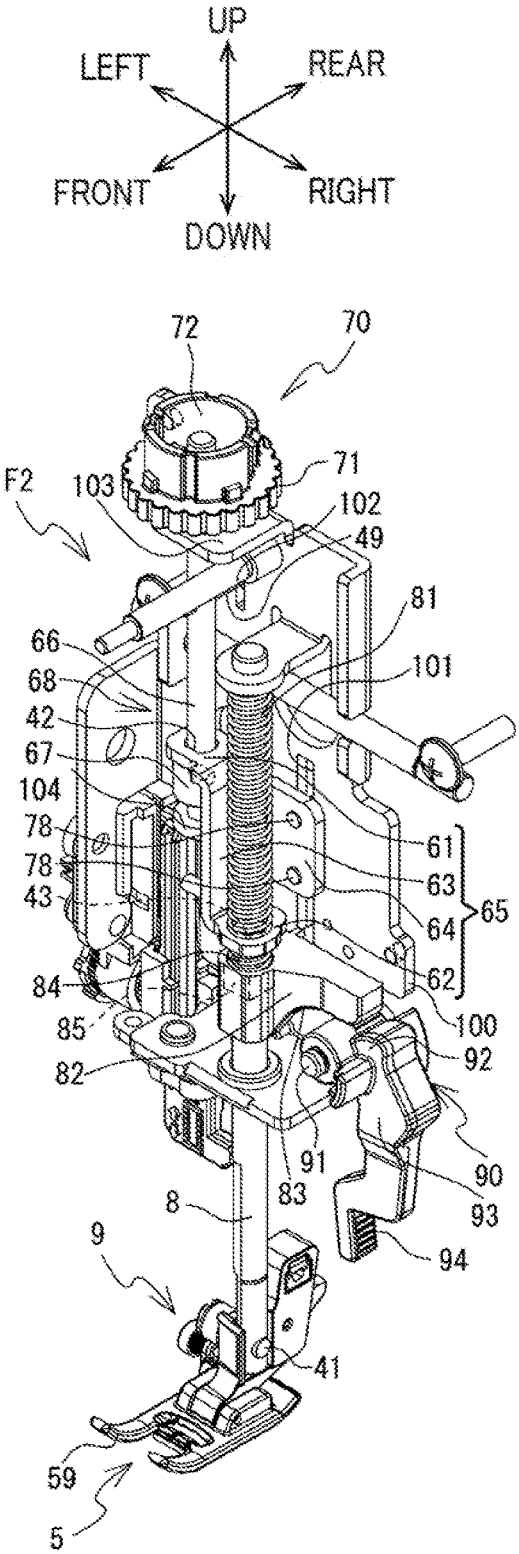
FIG. 2B illustrates a perspective view of the presser bar, presser bar clamp, adjusting mechanism, and changing member of the sewing machine on which the presser foot is mounted in state F2 in which the first wall portion of the adjustment part of the adjusting mechanism is spaced apart from the restricting part of the adjusting mechanism in the up-down direction.

The presser bar 8 extends in the up-down direction on the rear side of the needle bar 31. The presser bar 8 moves in the up-down direction in synchronization with the drive of the sewing machine motor 2, and more specifically in synchronization with the drive of the feed dog 19. As illustrated in FIGS. 2A and 2B, provided at the presser bar 8 are a presser bar spring 81, a presser bar clamp 82, and a lever 90. The presser bar spring 81 urges the presser bar 8 downward. The presser bar spring 81 is a coil spring placed around the presser bar 8. The presser bar clamp 82 is fixed to the presser bar 8.

Figure 3A:
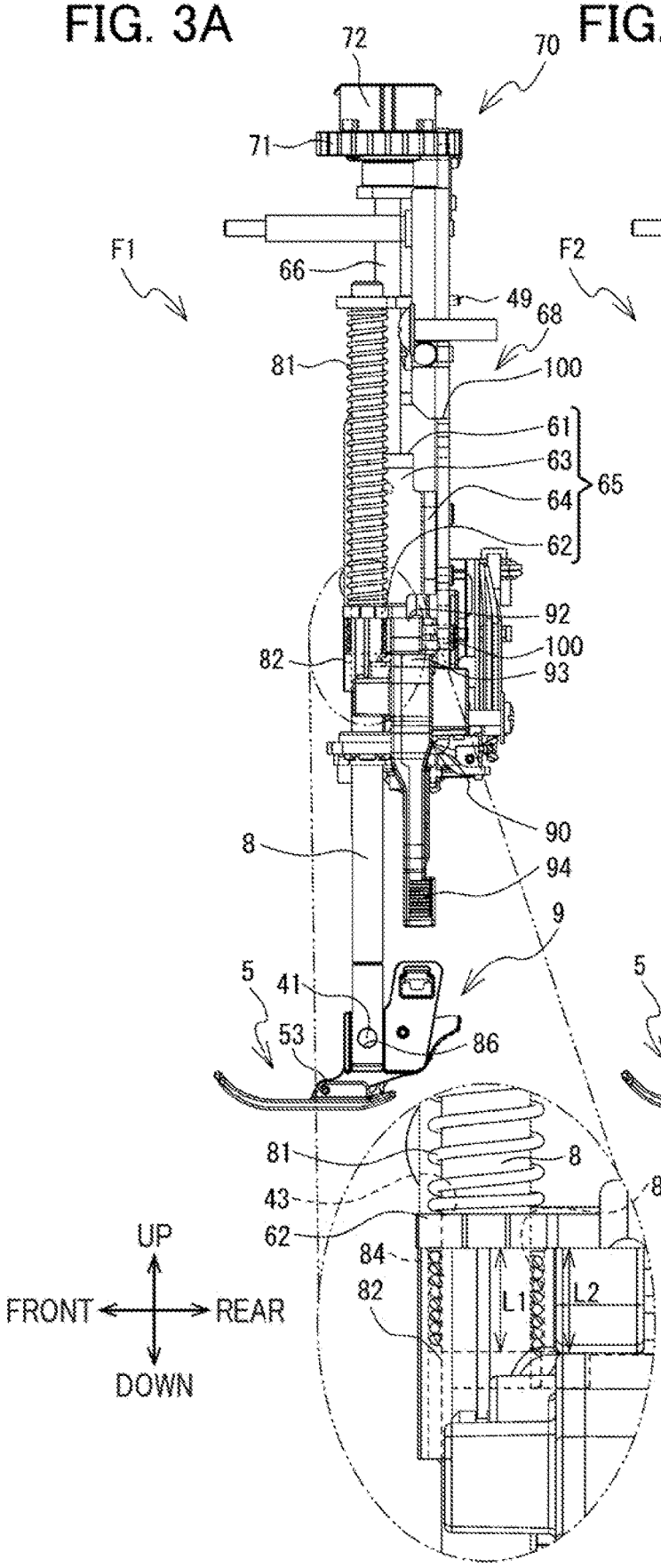
FIG. 3A illustrates a right-side view of the presser bar, presser bar clamp, adjusting mechanism, and changing member of the sewing machine on which the presser foot is mounted in state F1.
Figure 3B:
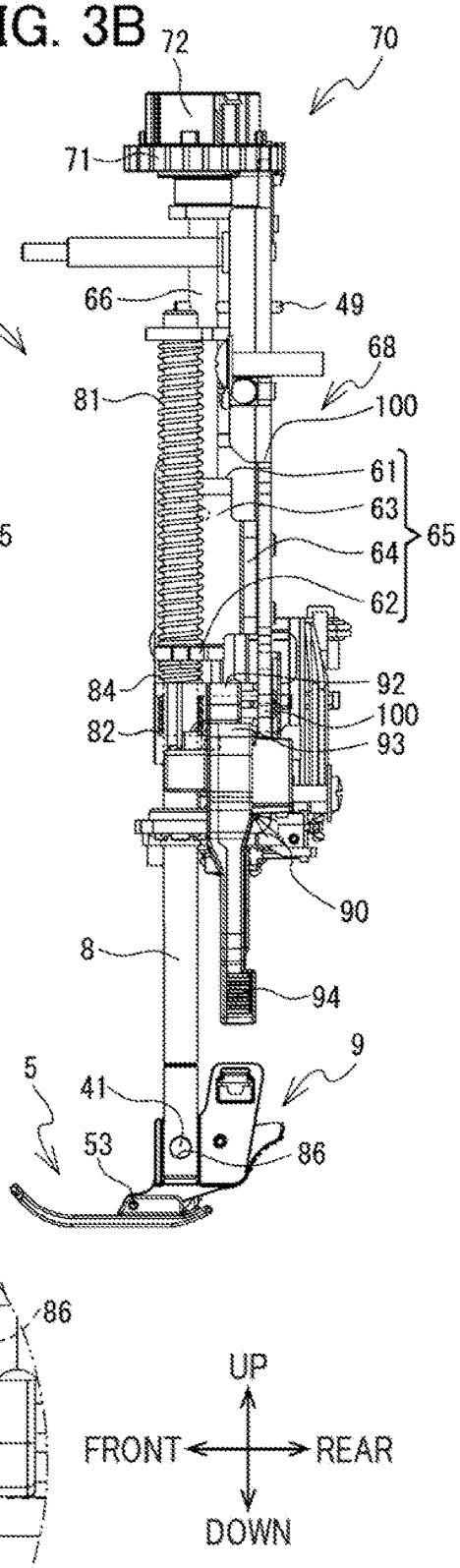
FIG. 3B illustrates a right-side view of the presser bar, presser bar clamp, adjusting mechanism, and changing member of the sewing machine on which the presser foot is mounted in state F2.
Figure 4A:
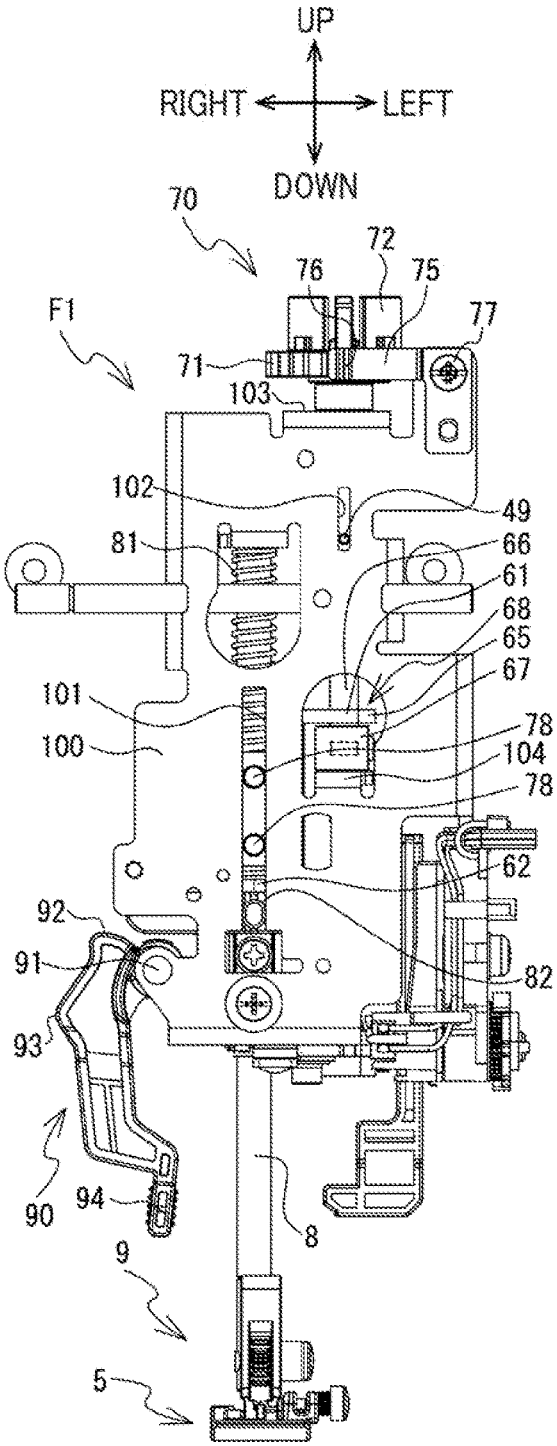
FIG. 4A illustrates a rear view of the presser bar, presser bar clamp, adjusting mechanism, and changing member of the sewing machine on which the presser foot is mounted in state F1.
Figure 4B:
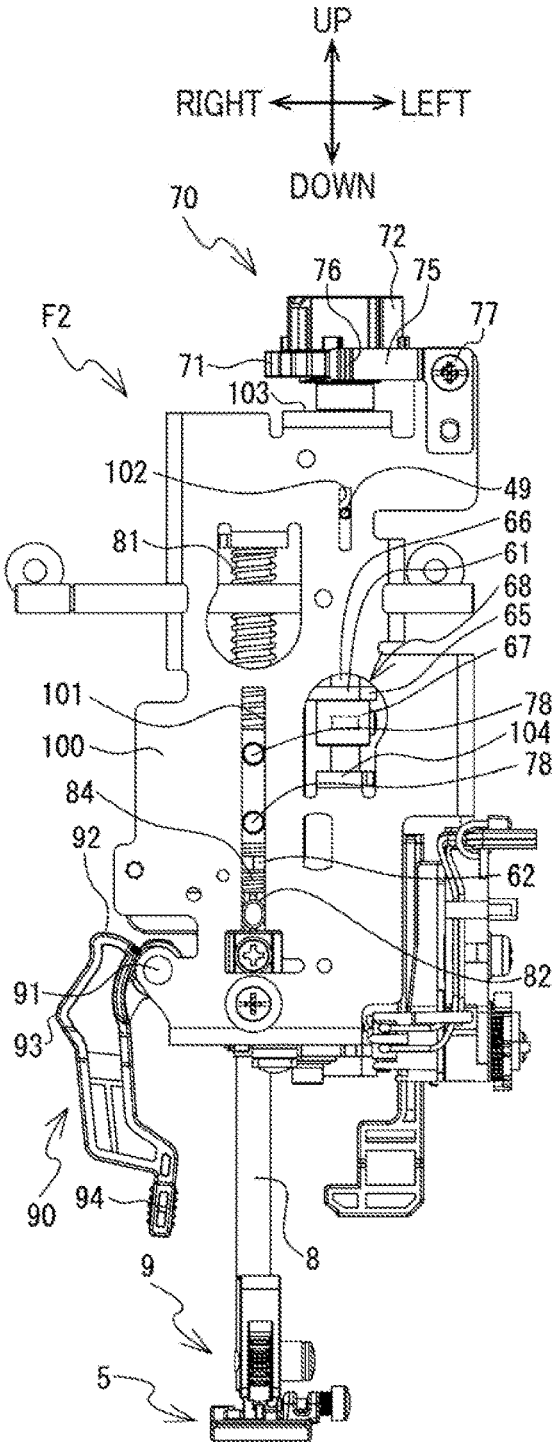
FIG. 4B illustrates a rear view of the presser bar, presser bar clamp, adjusting mechanism, and changing member of the sewing machine on which the presser foot is mounted in state F2.

The presser bar clamp 82 has a housing portion 85. As illustrated in FIG. 3A, the housing portion 85 is recessed downward into the body of the presser bar clamp 82 by a first length L1. The housing portion 85 accommodates the lower end portion of an adjustment spring 84. The urging force of the adjustment spring 84 is smaller than that of the presser bar spring 81. The adjustment spring 84 in the present embodiment is a coil spring. With the presser bar 8 inserted through the adjustment spring 84, the adjustment spring 84 is accommodated in the housing portion 85. In the up-down direction, the lower end of the adjustment spring 84 is defined by the bottom surface of the housing portion 85, and the upper end of the adjustment spring 84 is defined by an adjustment part 65 (described later) arranged above the presser bar clamp 82.

The lever 90 switches the position of the presser bar 8 in the up-down direction by being manually operated. The lever 90 includes a shaft 91, protrusions 92 and 93, and an operating part 94. The shaft 91 is provided inside the head section 14. The protrusions 92 and 93 are portions of the lever 90 near the shaft 91 that protrude away from the shaft 91.

The operating part 94 is the portion of the lever 90 farthest from the shaft 91. By operating the operating part 94 with a finger or other actuator, the user can rotate the lever 90 clockwise or counterclockwise in a front view about the shaft 91 in order to switch the presser bar 8 between a raised position and a lowered position. FIGS. 2A through 7 illustrate a state in which the operating part 94 is below the shaft 91 and the presser bar 8 is in the lowered position.

Figure 8:
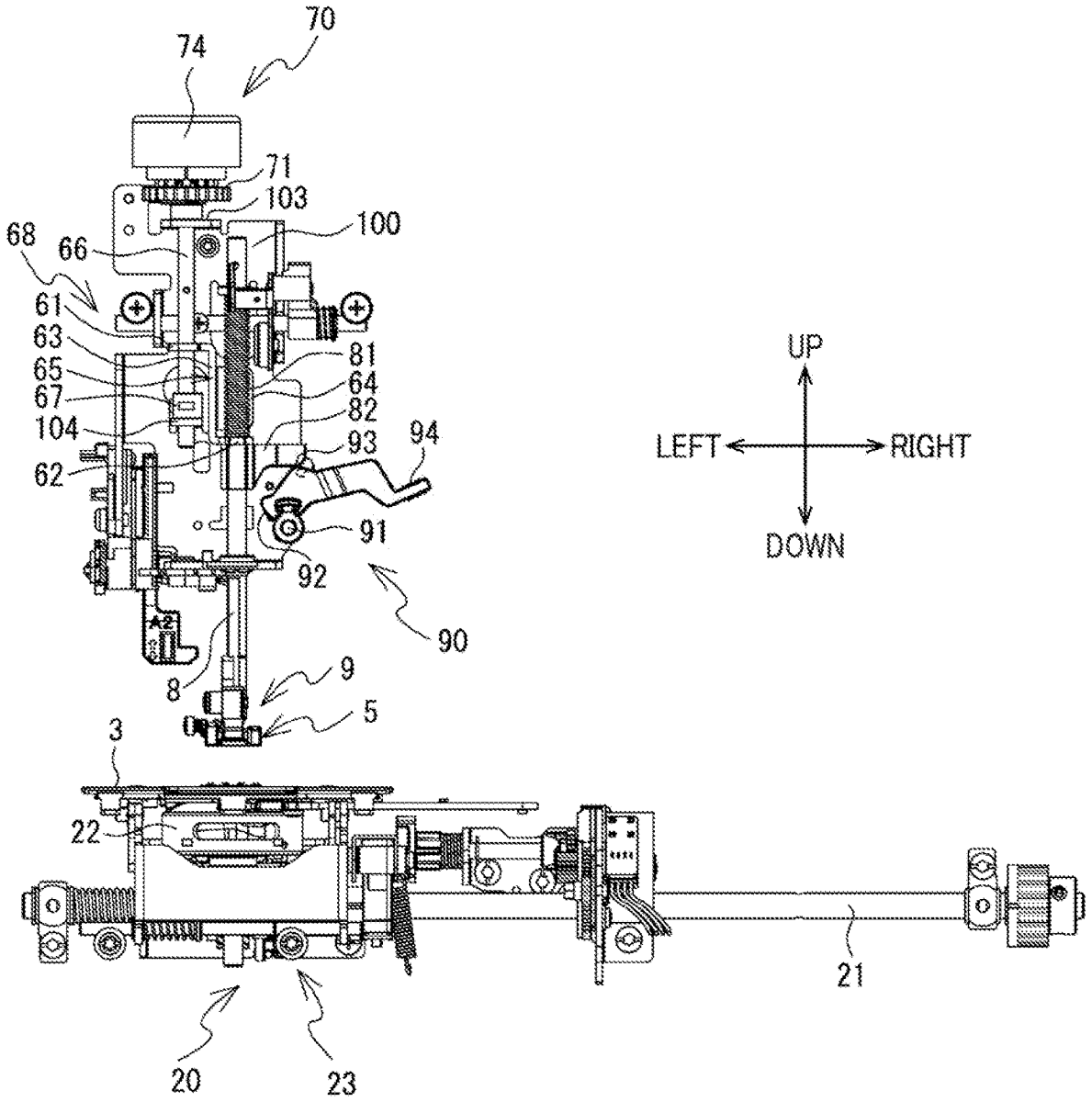
FIG. 8 illustrates a front view of the presser bar, presser bar clamp, adjusting mechanism, and changing member of the sewing machine on which the presser foot is mounted in a state where a protrusion of a lever is in contact with the presser bar clamp.

If the operating part 94 is rotated counterclockwise in a front view from the state in FIGS. 2A and 2B until the operating part 94 is positioned on the lower right of the shaft 91, the protrusion 92 of the lever 90 contacts a bottom surface 83 of the presser bar clamp 82, moving the presser bar 8 to the raised position. FIG. 8 illustrates a state in which the operating part 94 is positioned on the upper right of the shaft 91 and the presser bar 8 is in the raised position. The user performs operations for placing or retrieving a workpiece while the presser bar 8 is in the raised position.

As illustrated in FIG. 3A, the presser bar 8 is formed with a hole 86 in the lower end portion thereof. The hole 86 penetrates the presser bar 8 in the left-right direction. A pressing device 9 is detachably mounted on the lower end portion of the presser bar 8 by a screw 41 inserted into the hole 86. The pressing device 9 supports a presser foot 5 to be pivotable about a shaft 53 extending in the left-right direction.

The presser foot 5 has a plate-like shape that is rectangular in a plan view and is elongated in the front-rear direction. Both the front end portion and rear end portion of the presser foot 5 are curved upward. The presser foot 5 is formed with a notch 59 in the front portion thereof. When the pressing device 9 that supports the presser foot 5 is mounted on the lower end portion of the presser bar 8 and the sewing machine 1 is driven, the needle 35 passes through the rear portion of the notch 59. When the presser bar 8 is in the lowered position, the presser foot 5 contacts a workpiece placed on the throat plate 3 and presses the workpiece downward. By operating the changing member 70 in the sewing machine 1 of the present embodiment, the user can switch whether the pressing force transmitted to the presser foot 5 changes while the needle bar 31 reciprocates in the up-down direction or remains constant.

As illustrated in FIGS. 2A and 2B, the adjusting mechanism 68 includes an adjustment part 65, a restricting part 67, and a support part 66. The adjustment part 65 is supported to be movable in the up-down direction. The adjustment part 65 defines positions of the lower end of the presser bar spring 81 and the upper end of the adjustment spring 84. The adjustment part 65 is formed by bending a metal plate, for example. The adjustment part 65 is a plate-like part formed with a first insertion hole 42 through which the support part 66 is inserted and a second insertion hole 43 through which the presser bar 8 is inserted. The adjustment part 65 includes a first wall portion 61, a second wall portion 62, a third wall portion 63, and a fourth wall portion 64.

The first wall portion 61 is a plate-like portion that extends horizontally on the left side of the presser bar 8. The first insertion hole 42 is formed in the first wall portion 61. The first insertion hole 42 is a circular hole in a plan view and penetrates the first wall portion 61 in the up-down direction. By the first wall portion 61 contacting the restricting part 67, the restricting part 67 defines the lower end of the moving range of the adjustment part 65.

The second wall portion 62 is a plate-like portion that is provided below the first wall portion 61 and extends horizontally on the right side of the first wall portion 61. The second wall portion 62 is formed with the insertion hole 43. The insertion hole 43 is a circular hole in a plan view and penetrates the second wall portion 62 in the up-down direction. The presser bar 8 is inserted into the insertion hole 43 in the second wall portion 62. The second wall portion 62 defines positions of the lower end of the presser bar spring 81 and the upper end of the adjustment spring 84.

The third wall portion 63 connects the first wall portion 61 and second wall portion 62 in the up-down direction. The third wall portion 63 is a plate-like portion that extends in the up-down direction on the left side of the presser bar 8 and connects the right end portion of the first wall portion 61 to the left end portion of the second wall portion 62. Thus, the first wall portion 61, second wall portion 62, and third wall portion 63 of the adjustment part 65 form a crank-like shape that is a Z-like shape in a front view.

The fourth wall portion 64 is connected to the third wall portion 63 and extends parallel to the longitudinal direction of the presser bar 8. The fourth wall portion 64 also extends rightward from the rear end portion of the third wall portion 63. In the left-right direction, the left edge of the fourth wall portion 64 is positioned farther leftward than the presser bar 8 while the right edge of the fourth wall portion 64 is positioned farther rightward than the presser bar 8. As illustrated in FIGS. 2A, 2B, 4A and 4B, the fourth wall portion 64 has a pair of upper and lower pins 78 that protrude rearward.

Provided on the rear of the fourth wall portion 64 is a plate-shaped part 100 that extends parallel to the fourth wall portion 64. The range in which the plate-shaped part 100 extends in both the up-down direction and left-right direction is greater than the range in which the fourth wall portion 64 extends in both the up-down direction and left-right direction.

The plate-shaped part 100 is formed with slits 101 and 102. The slits 101 and 102 extend in the up-down direction and penetrate the plate-shaped part 100 in the front-rear direction. The slit 101 is formed to the rear of the presser bar 8. The pins 78 are inserted into the slit 101 of the plate-shaped part 100. The slit 101 guides movement of the adjustment part 65 in the up-down direction. The slit 102 is formed to the rear of the support part 66 and above the slit 101.

The plate-shaped part 100 is also provided with insertion parts 103 and 104 which are formed with holes (not illustrated) that penetrate the respective insertion parts 103 and 104 in the up-down direction. Each of the insertion parts 103 and 104 is formed by bending parts of the plate-shaped part 100 forward. The support part 66 is inserted into the holes formed in the insertion parts 103 and 104.

A restricting member 75 is fixed to the upper-left portion of the plate-shaped part 100 with a screw 77. The restricting member 75 is a leaf spring that extends in the left-right direction. The restricting member 75 is provided with a protrusion 76 on the right end thereof. The protrusion 76 protrudes forward from the restricting member 75. The protrusion 76 is formed by bending the leaf spring into a V-shape in a plan view.

As illustrated in FIGS. 2A and 2B, the restricting part 67 restricts the moving range of the adjustment part 65 when the restricting part 67 comes into contact with the adjustment part 65. The restricting part 67 has a parallelepiped shape and is fixed to the lower end portion of the support part 66. The restricting part 67 is disposed below the first wall portion 61 of the adjustment part 65 and is capable of contacting and separating from the bottom surface of the first wall portion 61. The restricting part 67 restricts the moving range of the adjustment part 65 by contacting the bottom surface of the first wall portion 61.

The support part 66 has a shaft-like shape and extends parallel to the longitudinal direction of the presser bar 8 on the left side of the same. The support part 55 supports the adjustment part 65 so as to be movable in the up-down direction. The support part 66 is inserted through the first insertion hole 42 of the first wall portion 61. The support part 66 includes shafts 69 and 49. The shaft 69 is a rod-like part provided on the upper end portion of the support part 66 and extends perpendicularly to the support part 66 (see FIGS. 5A and 5B). The shaft 69 extends leftward from the support part 66. The shaft 49 is a rod-like part provided below the shaft 69 and extends perpendicularly to the support part 66. The shaft 49 extends rearward from the support part 66 and is inserted into the slit 102 formed in the plate-shaped part 100. The slit 102 guides movement of the support part 66 in the up-down direction and restricts the support part 66 from rotating about an axis extending in the up-down direction.

The changing member 70 can change the position of the restricting part 67 in the up-down direction. The insertion part 104 in which the support part 66 is inserted beneath the restricting part 67 defines the lower end of the moving range for the restricting part 67. The changing member 70 includes a disc part 71, a cylindrical part 72, a cam contact part 73, and a cover part 74 (see FIGS. 1 and 6).

The disc part 71 has a generally circular shape in a plan view and is mounted around the support part 66. The disc part 71 is coupled with the lower end portion of the cylindrical part 72 and can rotate together with the cylindrical part 72. The disc part 71 has a plurality of recesses 79 in the outer circumference thereof. The protrusion 76 on the restricting member 75 provided to the rear of the changing member 70 can engage in and disengage from one of the recesses 79 in the disc part 71. The restricting member 75 restricts rotational movement of the disc part 71 and fixes the changing member 70 in a desired position.

The cylindrical part 72 has a hollow cylindrical shape extending in the up-down direction. The support part 66 is inserted into the cylindrical part 72, and the shaft 69 is disposed inside the cylindrical part 72. The changing member 70 functions as a dial that can rotate about the support part 66 in a plan view.

Figure 5A:
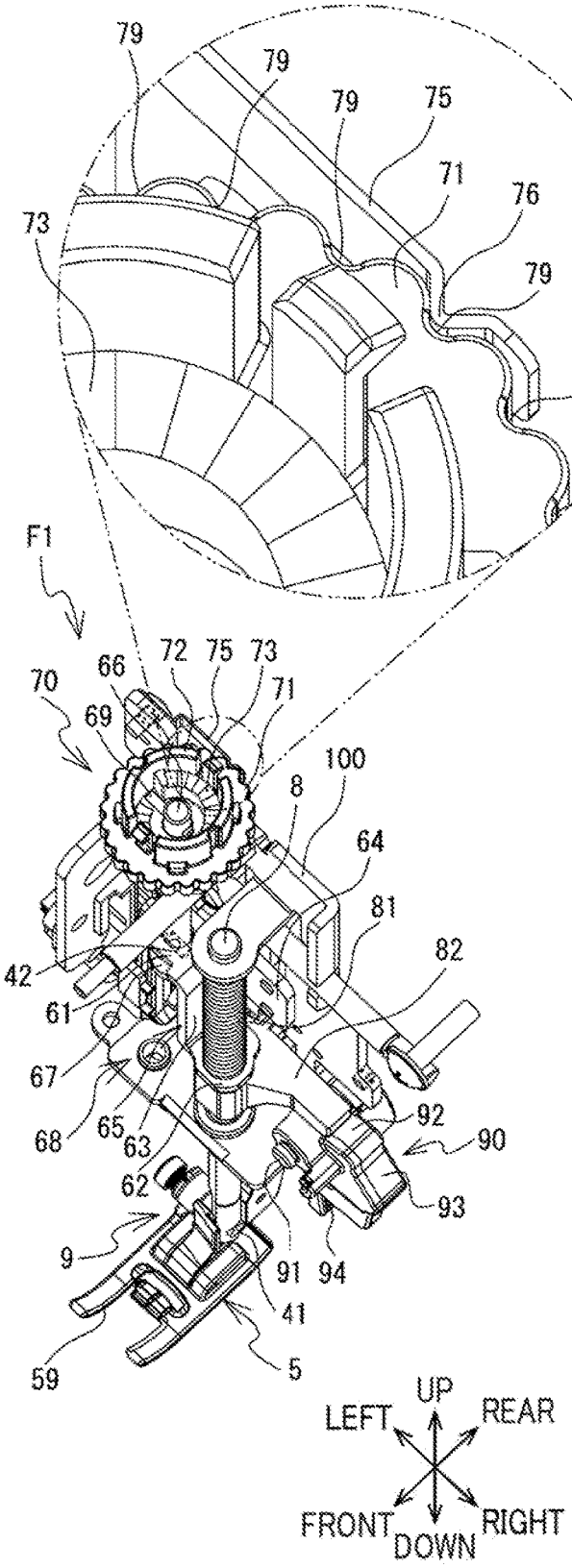
FIG. 5A illustrates a perspective view of the presser bar, presser bar clamp, adjusting mechanism, and changing member of the sewing machine on which the presser foot is mounted in state F1.
Figure 5B:
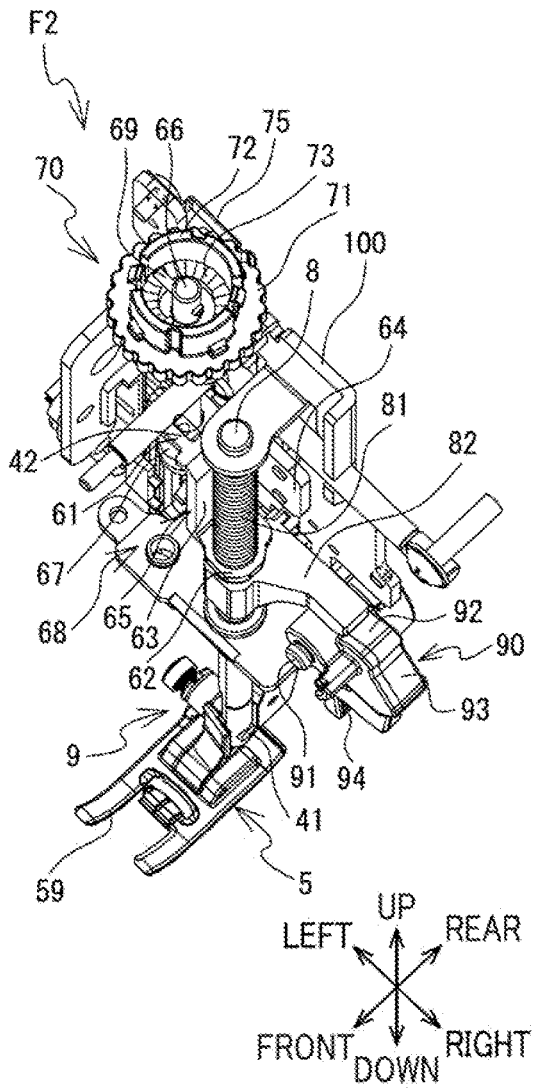
FIG. 5B illustrates a perspective view of the presser bar, presser bar clamp, adjusting mechanism, and changing member of the sewing machine on which the presser foot is mounted in state F2.

As illustrated in FIGS. 5A and 5B, the cam contact part 73 is a cam surface on an end cam provided along the inner circumference of the cylindrical part 72 while sloping in a spiral around the support part 66. The cam contact part 73 contacts the shaft 69 of the support part 66. The cover part 74 covers the top of the cylindrical part 72. The cover part 74 is exposed on the outside of the cover 17 of the sewing machine 1. The cover part 74 can be engaged with and disengaged from the cylindrical part 72 and can rotate together with the cylindrical part 72 when engaged therewith. To change the position of the restricting part 67 in the up-down direction, the user operates the cover part 74 of the changing member 70, which is exposed on the outside. Alternatively, the user may remove the cover 17 from the sewing machine 1 to operate the disc part 71.

The user can change the position of the shaft 69 in the up-down direction by rotating the changing member 70 to change a portion of the cam contact part 73 contacting the shaft 69. Since the shaft 49 of the support part 66 is inserted into the slit 102, the support part 66 does not rotate in response to rotation of the changing member 70. The shaft 69 moves in the up-down direction in accordance with the position in the up-down direction of the portion of the cam contact part 73 that contacts the shaft 69. When the user rotates the changing member 70, the support part 66 moves in the up-down direction while guided in the slit 102. Thus, when the user changes a portion of the cam contact part 73 that contacts the shaft 69, the cam contact part 73 changes the position in the up-down direction of the restricting part 67 fixed on the lower end portion of the support part 66.

Provided that the presser bar clamp 82 and lever 90 are spaced apart from each other in the up-down direction, the positions of the presser bar clamp 82 and presser bar 8 in the up-down direction change in accordance with the position of the feed dog 19 in the up-down direction. By operating the changing member 70, the position of the restricting part 67 in the up-down direction is changed so that the first wall portion 61 of the adjustment part 65 comes into contact with the restricting part 67 each time the needle bar 31 reciprocates in the up-down direction. When the first wall portion 61 of the adjustment part 65 comes into contact with the restricting part 67 while the needle bar 31 of the sewing machine 1 reciprocates in the up-down direction and prevents the adjustment part 65 from moving farther downward, the second wall portion 62 of the adjustment part 65 becomes spaced apart from the presser bar clamp 82 in the up-down direction. Consequently, the urging force of the presser bar spring 81 is no longer transmitted to the presser bar clamp 82. At this time, the urging force of the adjustment spring 84 is transmitted to the presser bar clamp 82.

Next, an example of changing the position of the restricting part 67 in the up-down direction while the presser bar 8 is in the lowered position will be described with reference to FIGS. 2A through 7. To set the pressing force applied to the presser foot 5 to a force suitable for normal sewing, the user places the restricting part 67 in a reference position after ensuring that the top of the feed dog 19 is above the top surface of the throat plate 3 and a workpiece is not positioned between the throat plate 3 and presser foot 5 (first condition), as depicted by state F1 of FIGS. 2A, 3A, 4A and 5A and as illustrated in FIG. 6.

Under the first condition, the presser bar clamp 82 is spaced apart from the lever 90 in the up-down direction and in contact with the second wall portion 62 of the adjustment part 65. Under the first condition, the adjustment spring 84 is in its most compressed state, and a second length L2 in the up-down direction of the adjustment spring 84 is equal to or smaller than the first length L1 in the up-down direction of the housing portion 85 that accommodates the lower end portion of the adjustment spring 84. Under the first condition, when a workpiece is placed between the throat plate 3 and presser foot 5 and sewing is performed, the urging force of the presser bar spring 81 is constantly transmitted to the presser foot 5 while the needle bar 31 of the sewing machine 1 reciprocates in the up-down direction.

Figure 6:
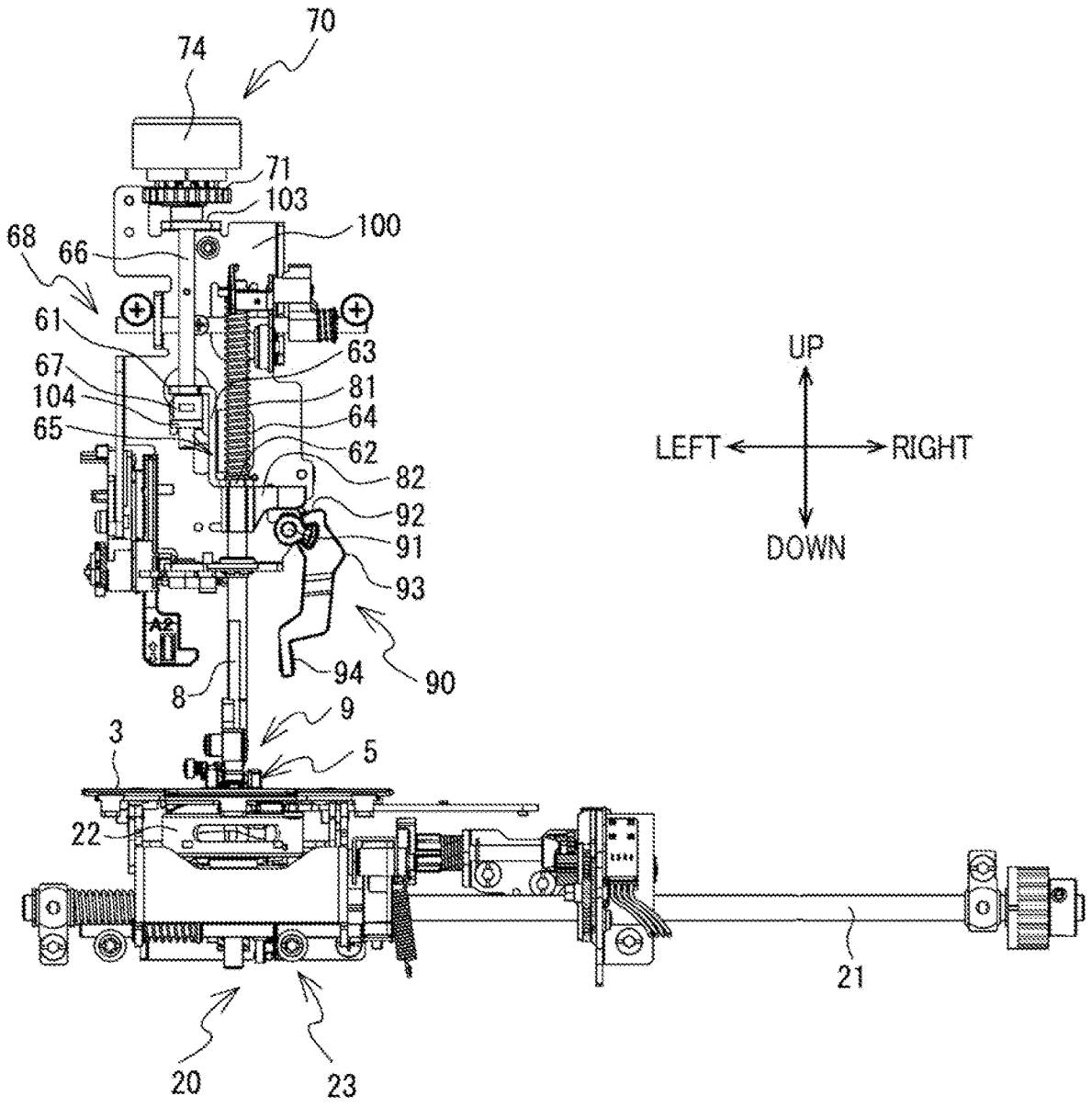
FIG. 6 illustrates a front view of the presser bar, presser bar clamp, adjusting mechanism, and changing member of the sewing machine on which the presser foot is mounted in a state where the restricting part of the adjusting mechanism is placed in a reference position.
Figure 7:
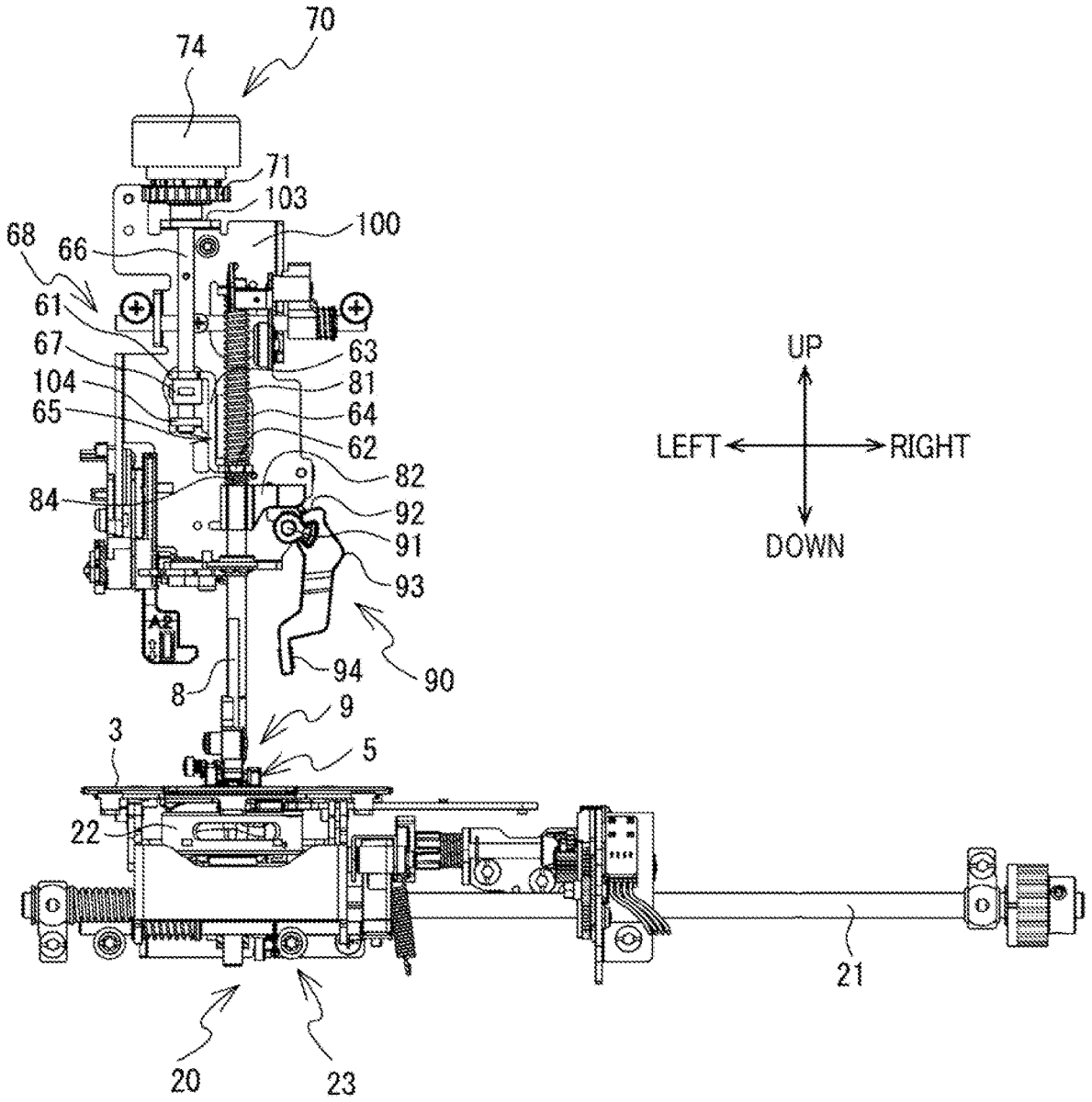
FIG. 7 illustrates a front view of the presser bar, presser bar clamp, adjusting mechanism, and changing member of the sewing machine on which the presser foot is mounted in a state where the restricting part of the adjusting mechanism is placed in a position raised from the reference position by 4 mm.

To set the pressing force applied to the presser foot 5 to a force suitable for curved line sewing, as depicted by state F2 of FIGS. 2B, 3B, 4B and 5B and illustrated in FIG. 7, while the sewing machine 1 is in the first condition depicted by state F1 in FIGS. 2A, 3A, 4A and 5A and illustrated in FIG. 6, the user raises the restricting part 67 from the reference position by an amount equivalent to the thickness of the workpiece (e.g., 4 mm) by operating the changing member 70 (second condition).

Under the second condition, the presser bar clamp 82 is spaced apart from the lever 90 in the up-down direction and is also spaced apart from the second wall portion 62 of the adjustment part 65 in the up-down direction. Under the second condition, when a workpiece having a thickness of 4 mm is placed between the throat plate 3 and presser foot 5 and sewing is begun, the urging force is transmitted from the presser bar spring 81 to the presser foot 5 during periods of time when the restricting part 67 is spaced apart from the first wall portion 61 of the adjustment part 65 in the up-down direction as the needle bar 31 reciprocates in the up-down direction. However, during periods of time when the restricting part 67 is in contact with the first wall portion 61 of the adjustment part 65 in the up-down direction, the urging force of the presser bar spring 81 is not transmitted to the presser foot 5, but rather the urging force of the adjustment spring 84 is transmitted to the presser foot 5. By operating the changing member 70 to adjust the position of the restricting part 67 in the up-down direction according to the thickness of the workpiece, the user can change the pressing force applied to the workpiece while the needle bar 31 reciprocates in the up-down direction.

Next, a case in which the presser bar 8 is disposed in the raised position will be described with reference to FIG. 8. As illustrated in FIG. 8, when the user operates the lever 90 from the first condition of FIG. 6 so that the protrusion 93 of the lever 90 contacts the presser bar clamp 82 (third condition), the presser bar clamp 82 and presser bar 8 are lifted upward by the protrusion 93 and the presser foot 5 becomes spaced apart from the throat plate 3 in the up-down direction. In this state, the user performs operations to place a workpiece between the throat plate 3 and presser foot 5 and to mount the pressing device 9 on or remove the pressing device 9 from the lower end portion of the presser bar 8.

Next, relationships among the position of the needle bar 31 in the up-down direction (VERTICAL POSITION OF NEEDLE BAR), the position of the feed dog 19 in the up-down direction (VERTICAL POSITION OF FEED DOG), the position of the presser bar clamp 82 in the up-down direction (VERTICAL POSITION OF PRESSER BAR CLAMP), the pressing force applied by the presser foot 5 to the workpiece (PRESSING FORCE OF PRESSER FOOT), and the gap between the restricting part 67 and the first wall portion 61 of the adjustment part 65 in the up-down direction (VERTICAL GAP BETWEEN RESTRICTING PART AND FIRST WALL PORTION) corresponding to the rotated angle of the sewing machine motor 2 will be described with reference to FIG. 9. In the sewing machine 1 of the present embodiment, the needle bar 31 reciprocates once in the up-down direction when the sewing machine motor 2 rotates once. The "PRESSING FORCE OF PRESSER FOOT" indicated in FIG. 9, i.e., the pressing force applied to the presser foot 5, changes due to displacement of the adjustment spring 84 and minute changes due to displacement of the presser bar spring 81 that accompany movement of the feed dog 19 in the up-down direction.

In FIG. 9, the pressing force applied to the presser foot 5 during a period P2 is expressed on the basis of the assumption that the pressing force applied during periods P1 is 100. The periods P1 denote periods of time during which the first wall portion 61 of the adjustment part 65 and the restricting part 67 are spaced apart from each other in the up-down direction. The period P2 denotes a period of time during which the first wall portion 61 of the adjustment part 65 is in contact with the restricting part 67 in the up-down direction. The pressing force applied to the presser foot 5 during the period P2 is smaller than the pressing force applied to the presser foot 5 during the periods P1. During the period P2, the presser bar clamp 82 is lowered below the second wall portion 62 of the adjustment part 65 by the urging force of the adjustment spring 84 until the presser foot 5 contacts the workpiece. As a result, the second wall portion 62 and presser bar clamp 82 become spaced apart from each other in the up-down direction. During the periods P1, the presser foot 5 is raised by the feed dog 19, pushing the presser bar 8 upward. As a result, the presser bar clamp 82 moves upward against the urging force of the adjustment spring 84 and contacts the second wall portion 62 in the up-down direction. Since the adjustment part 65 that includes the second wall portion 62 can also move upward, the presser bar clamp 82 moves upward together with the adjustment part 65.

In other words, with the adjusting mechanism 68 of the embodiment, the adjustment part 65 is spaced apart from the restricting part 67 during first prescribed periods of time in which the top of the feed dog 19 is above the top surface of the throat plate 3, so that the urging force of the presser bar spring 81 is transmitted to the presser foot 5 mounted on the lower end portion of the presser bar 8. The first prescribed periods are periods of time in which the top of the feed dog 19 is above the top surface of the throat plate 3 and the adjustment part 65 is in contact with the presser bar clamp 82. During the first prescribed periods, the needle 35 is positioned above the workpiece. Hence, the sewing machine 1 applies the pressing force of the presser bar spring 81 to the presser foot 5 during periods of time in which the feed dog 19 conveys the workpiece in the conveying direction. As a result, the sewing machine 1 can stably convey the workpiece in the conveying direction while the workpiece is firmly held in the up-down direction between the presser foot 5 and feed dog 19.

On the other hand, during second prescribed periods of time in which the top of the feed dog 19 is beneath the top surface of the throat plate 3, the adjustment part 65 of the adjusting mechanism 68 is in contact with the restricting part 67 and the urging force of the presser bar spring 81 is not transmitted to the presser foot 5. The second prescribed periods are periods of time in which the top of the feed dog 19 is beneath the top surface of the throat plate 3, and the adjustment part 65 is in contact with the restricting part 67 while being spaced apart from the presser bar clamp 82 in the up-down direction. The second prescribed periods include periods of time in which the needle 35 pierces the workpiece.

In this way, the sewing machine 1 can transmit the pressing force of the presser bar spring 81 to the presser foot 5 for pressing the workpiece, just as in the conventional sewing machine, when the workpiece is conveyed by the feed dog 19, while reducing the pressing force applied to the presser foot 5 to a force less than that applied by the conventional sewing machine during the period P2 in which the needle 35 is piercing the workpiece. Therefore, the user of the sewing machine 1 can change the direction of the workpiece relative to the throat plate 3 during sewing more easily than on the conventional sewing machine, facilitating the sewing of curved parts.

Next, a sewing machine according to a variation of the embodiment will be described with reference to FIGS. 10 through 13, wherein like parts and components are designated with the same reference numerals. The sewing machine of this variation has a support plate part 110, a presser bar clamp 182, a lever 97, and an adjusting mechanism 200.

As illustrated in FIGS. 10 through 13, the support plate part 110 has a plate-like shape that extends parallel to the presser bar 8 and in the left-right direction on the rear side of the presser bar 8. The support plate part 110 is formed with slits 111 and 112. The slits 111 and 112 are formed in the portion of the support plate part 110 rearward of the presser bar 8 and extend in the up-down direction. The slit 112 is formed on the right side of the slit 111. The support plate part 110 has support parts 113 and 114. The support part 113 is formed with a hole 115 penetrating therethrough in the up-down direction. The support part 114 is formed with a hole 116 penetrating therethrough in the up-down direction. Each of the support parts 113 and 114 is formed by bending a portion of the support plate part 110 forward. The presser bar 8 is inserted through the holes 115 and 116.

The presser bar clamp 182 is fixed to the presser bar 8 and defines the position of the lower end of the adjustment spring 84. The presser bar clamp 182 has a contact part 183 that extends rearward. The contact part 183 is inserted through the slit 112. The presser bar clamp 182 also has a housing portion 185. The housing portion 185 is recessed downward into the body of the presser bar clamp 82 and accommodates the lower end portion of the adjustment spring 84.

The lever 97 switches the position of the presser bar 8 in the up-down direction by being manually operated. The lever 97 includes the shaft 91 and protrusions 92 and 93, which are identical to those of the lever 90 in the embodiment described above, as well as an operating part 96. The shaft 91 extends in the left-right direction on the rear side of the presser bar 8. The operating part 96 is the portion of the lever 97 farthest from the shaft 91. When the user rotates the lever 97 clockwise about the shaft 91 in a right-side view, one of the protrusions 92 and 93 contacts the contact part 183, raising the presser bar 8 from the lowered position illustrated in FIG. 10 to a raised position (not illustrated).

In addition to the adjustment spring 84 in the embodiment described above, the adjusting mechanism 200 includes an adjustment part 160, a restricting part 122, and an urging member 150. The adjustment part 160 includes a contact part 168, and a connecting part 151.

The contact part 168 defines the lower end of the presser bar spring 81 and the upper end of the adjustment spring 84. The contact part 168 has a cylindrical shape extending in the up-down direction, and is formed with an insertion hole 169 penetrating therethrough in the up-down direction. The presser bar 8 is inserted through the insertion hole 169. The contact part 168 can move along the presser bar 8 relative to the same. The diameter of the insertion hole 169 on the lower end portion is greater than the diameter of the insertion hole 169 on the upper end portion. The upper end portion of the adjustment spring 84 placed around the presser bar 8 is accommodated in the lower end portion of the insertion hole 169. The contact part 168 further includes a protruding part 184 that extends rearward from the lower-rear portion of the contact part 168. The protruding part 184 is inserted through the slit 111.

The connecting part 151 restricts the protruding part 184 of the contact part 168 from moving downward and can move in the up-down direction together with the contact part 168. The connecting part 151 has a plate-like shape that extends parallel to the presser bar 8 on the rear side of the same. The connecting part 151 is formed with a slit 153 that extends in the up-down direction. The protruding part 184 is inserted through the slit 153, and is restricted from moving downward by the slit 153.

The urging member 150 urges the connecting part 151 upward. The urging member 150 is a coil spring having one end portion fixed to the upper end portion of the connecting part 151 and the other end portion fixed to the upper-left part of the support plate part 110. The urging member 150 extends diagonally downward and rightward from the upper-left part of the support plate part 110.

The restricting part 122 is a lever that can contact and be spaced apart from the connecting part 151. By contacting the connecting part 151, the restricting part 122 restricts the connecting part 151 from moving in the up-down direction. The restricting part 122 is supported by a support part 123 that is U-shaped in a rear view and is provided to the rear of the support plate part 110. The restricting part 122 is rotatable about a rotational shaft 121 extending in the left-right direction. The outer circumferential surface of the restricting part 122 is a cam surface whose distance from the rotational shaft 121 is not uniform. The restricting part 122 switches between a state in contact with the connecting part 151 and a state spaced apart from the connecting part 151 depending on the posture of the restricting part 122, i.e., the rotated position of the restricting part 122.

When the restricting part 122 extends diagonally downward and rearward from the rotational shaft 121 and the restricting part 122 is spaced apart from the connecting part 151, as illustrated in FIG. 11, the connecting part 151 can move in the up-down direction together with the contact part 168. As a result, the adjustment part 160 contacts the presser bar clamp 182 in the up-down direction and can move in the up-down direction together with the presser bar 8. Since the adjustment part 160 transmits the urging force of the presser bar spring 81 to the presser bar clamp 182, the urging force from the presser bar spring 81 is constantly transmitted to the presser foot 5 while the needle bar 31 reciprocates in the up-down direction. The state in which the restricting part 122 does not restrict movement of the connecting part 151 in the up-down direction will be called an unlocked state. In this unlocked state, the urging force of the presser bar spring 81 is transmitted to the presser foot 5 regardless of the position of the feed dog 19 in the up-down direction, achieving the same effects as in the first prescribed periods of the embodiment described above.

On the other hand, when the rotational shaft 121 extends diagonally upward and rearward from the rotational shaft 121 and the restricting part 122 is in contact with the connecting part 151, as illustrated in FIG. 12, the restricting part 122 presses the connecting part 151 forward. At this time, the connecting part 151 is restricted by the restricting part 122 from moving, i.e., the connecting part 151 is locked. More specifically, the restricting part 122 presses the connecting part 151 against a rubber plate 152 provided between the support plate part 110 and the connecting part 151 in the front-rear direction, and the friction generated between the connecting part 151 and rubber plate 152 restricts movement of the connecting part 151. When the connecting part 151 moves downward in particular, the rotational shaft 121 rotates clockwise in a left-side view and the connecting part 151 is further pressed against the rubber plate 152 by the restricting part 122, so that the restricting part 122 restricts the connecting part 151 from moving downward. The connecting part 151 is not restricted from moving upward as much as when the connecting part 151 moves downward since the restricting part 122 rotates counterclockwise in a left-side view, which is the direction that reduces the forward pressing force applied by the restricting part 122 to the connecting part 151.

By the connecting part 151 being restricted from moving downward, the contact part 168 is also restricted from moving downward. Thus, during periods of time in which the adjustment part 160 and presser bar clamp 182 are spaced apart from each other in the up-down direction, the adjustment part 160 does not transmit the urging force of the presser bar spring 81 to the presser bar clamp 182, but rather the urging force of the adjustment spring 84 is transmitted to the presser foot 5. Since the adjustment part 160 cannot move in the up-down direction during periods of time in which the adjustment part 160 is in contact with the presser bar 182 in the up-down direction, the presser foot 5 is pressed downward by the amount of force that the feed dog 19 pushes upward. Hence when the sewing machine 1 of this variation is in the locked state illustrated in FIG. 12, in which the restricting part 122 restricts the connecting part 151 from moving in the up-down direction, the urging force of the presser bar spring 81 is not transmitted to the presser foot 5 regardless of the position of the feed dog 19 in the up-down direction, but only the urging force of the adjustment spring 84 is transmitted to the presser foot 5, thereby achieving the same effects as in the second prescribed periods of time in the embodiment described above.

In the embodiment and its variation described above, the sewing machine 1 is an example of the claimed sewing machine. The sewing machine motor 2 is an example of the claimed sewing machine motor. The needle bar 31 is an example of the claimed needle bar, and the needle 35 is an example of the needle. The throat plate 3 is an example of the claimed throat plate, the needle hole 25 is an example of the claimed needle hole, and the slits 26 are an example of the claimed opening. The feed dog 19 is an example of the claimed feed dog. The feed mechanism 23 is an example of the claimed feed mechanism. The presser bar 8 is an example of the claimed presser bar. The presser foot 5 is an example of the presser foot. The presser bar spring 81 is an example of the claimed presser bar spring. The adjustment spring 84 is an example of the claimed adjustment spring. The presser bar clamps 82 and 182 are examples of the claimed presser bar clamp. The adjusting mechanisms 68 and 200 are examples of the claimed adjusting mechanism. The adjustment parts 65 and 160 are examples of the claimed adjustment part. The restricting parts 67 and 122 are examples of the claimed restricting part. The periods P1 are examples of the claimed first prescribed period of time. The periods P2 are examples of the claimed second prescribed period of time. The support part 66 is an example of the claimed support part. The first insertion hole 42 is an example of the claimed first insertion part. The second insertion hole 43 is an example of the claimed second insertion part. The first wall portion 61 is an example of the claimed first wall portion. The second wall portion is an example of the claimed second wall portion. The third wall portion 63 is an example of the claimed third wall portion. The fourth wall portion 64 is an example of the claimed fourth wall portion. The housing portions 85 and 185 are examples of the claimed housing portion. The changing member 70 is an example of the claimed changing member. The support part 66 is an example of the claimed support part. The shaft 69 is an example of the claimed contact part of the support part. The cam contact part 73 is an example of the claimed contact-receiving part. The contact part 168 is an example of the claimed contact part f the adjustment part. The connecting part 151 is an example of the claimed connecting part. The urging member 150 is an example of the claimed urging member. The restricting part 122 is an example of the claimed lever.

The sewing machine 1 of the embodiment described above is provided with the sewing machine motor 2, needle bar 31, throat plate 3, feed dog 19, feed mechanism 23, presser bar 8, presser bar spring 81, adjustment spring 84, presser bar clamp 82, and adjusting mechanism 68. A needle 35 can be mounted on the lower end portion of the needle bar 31, and the needle bar 31 is driven by the sewing machine motor 2 to move in the up-down direction. The needle 35 passes through the needle hole 25 formed in the throat plate 3. The feed dog 19 retractably emerge from the slits 26 formed in the throat plate 3 to convey a workpiece placed on the throat plate 3. The feed mechanism 23 is driven by the sewing machine motor 2 to drive the feed dog 19. The presser bar 8 moves in the up-down direction in synchronization with movement of the feed dog 19. The presser bar spring 81 urges the presser bar 8 downward with an urging force. The adjustment spring 84 urges the presser bar 8 downward with an urging force smaller than that of the presser bar spring 81. The presser bar clamp 82 is fixed to the presser bar 8 and defines the position of the lower end of the adjustment spring 84. The adjusting mechanism 68 has the adjustment part 65 and restricting part 67. The adjustment part 65 is supported to be movable in the up-down direction and defines the positions of the lower end of the presser bar spring 81 and upper end of the adjustment spring 84. The restricting part 67 restricts the moving range of the adjustment part 65 when the restricting part 67 contacts the adjustment part 65. During first prescribed periods of time in which the top of the feed dog 19 is above the top surface of the throat plate 3, the adjustment part 65 of the adjusting mechanism 68 is spaced apart from the restricting part 67 in the up-down direction to cause the urging force of the presser bar spring 81 to be transmitted to the presser foot 5 mounted on the lower end portion of the presser bar 8. During second prescribed periods of time in which the top of the feed dog 19 is beneath the top surface of the throat plate 3, the adjustment part 65 of the adjusting mechanism 68 is in contact with the restricting part 67 to prevent the urging force of the presser bar spring 81 from being transmitted to the presser foot 5.

With the configuration described above, the adjusting mechanism 68 of the sewing machine 1 can switch whether the urging force of the presser bar spring 81 is transmitted to the presser foot 5 or not according to the position of the feed dog 19 in the up-down direction. Thus, the adjusting mechanism 68 helps to change the amount of pressing force applied by the presser foot 5 to the workpiece through a simpler configuration than the conventional sewing machine.

The adjusting mechanism 68 is provided with the support part 66 that has a shaft-like shape extending parallel to the longitudinal direction of the presser bar 8. The support part 66 supports the adjustment part 65 to be movable in the up-down direction. The restricting part 67 is fixed to the lower end portion of the support part 66. The adjustment part 65 is a plate-like member formed with the first insertion hole 42 and second insertion hole 43. The first insertion hole 42 receives insertion of the support part 66, and the second insertion hole 43 receives insertion of the presser bar 8. Thus, the sewing machine 1 achieves a relatively simple configuration for the adjusting mechanism 68.

The adjustment part 65 has a crank-like shape formed of the first wall portion 61, second wall portion 62, and third wall portion 63. The first wall portion 61 is formed with the first insertion hole 42. The first wall portion 61 contacts the restricting part 67 to cause the restricting part 67 to define the lower end of the moving range of the adjustment part 65. The second wall portion 62 is provided below the first wall portion 61 and is formed with the second insertion hole 43. The third wall portion 63 connects the first wall portion 61 and the second wall portion 62 in the up-down direction. By having the second wall portion 62 arranged below the first wall portion 61 in the sewing machine 1, the adjustment part 65 helps achieve a relatively short length of the support part 66 in the up-down direction.

The adjustment part 65 has the fourth wall portion 64 that is connected to the third wall portion 63 and extends parallel to the longitudinal direction of the presser bar 8. The fourth wall portion 64 of the adjustment part 65 in the sewing machine 1 suppresses the adjustment part 65 from rotating about the presser bar 8 while moving in the up-down direction.

As illustrated in FIG. 3A, the presser bar clamp 82 has the housing portion 85, which is recessed downward by the first length L1 and accommodates the lower end of the adjustment spring 84. When the adjustment spring 84 is in its most compressed state, the adjustment spring 84 has the second length L2 in the up-down direction, that is smaller than or equal to the first length L1. With the configuration of the sewing machine 1, the presser bar clamp 82 rises in response to the top of the feed dog 19 moving above the top surface of the throat plate 3, and the upper end of the presser bar clamp 82 comes into contact with the lower end of the adjustment part when the adjustment spring 84 is compressed. In this state, adjustment part 65 moves upward together with the presser bar clamp 82. The presser bar clamp 82 of the sewing machine 1 can better accommodate the adjustment spring 84 in a compact state to raise the adjustment part 65 more stably than if the housing portion 85 were not provided.

The sewing machine 1 is provided with the changing member 70, which can change the position of the restricting part 67 in the up-down direction. By changing the position of the restricting part 67 in the up-down direction according to the thickness of the workpiece, the changing member 70 can switch whether the urging force of the presser bar spring 81 is transmitted to the presser foot 5 according to the position of the feed dog 19 in the up-down direction for workpieces of different thicknesses. Arranging the changing member 70 on the upper end portion of the support part 66 facilitates the user in operating the changing member 70.

The support part 66 is provided with the shaft 69 on the upper end portion thereof. The changing member 70 has the cam contact part 73 that contacts the shaft 69. The changing member changes the portion of the restricting part 67 in the up-down direction by changing a portion of the cam contact part 73 that contacts the shaft 69. The changing member 70 can change the position of the restricting part 67 in the up-down direction through a relatively simple structure.

The adjustment part 160 of the sewing machine according to the variation has the contact part 168 and the connecting part 151. The contact part 168 defines the positions of the lower end of the presser bar spring 81 and the upper end of the adjustment spring 84. The connecting part 151 can move in the up-down direction together with the contact part 168 and restricts the contact part 168 from moving downward. The adjusting mechanism 200 is provided with the urging member 150 that urges the connecting part 151 upward. The restricting part 122 is provided to be capable of contacting and separating from the connecting part 151. The restricting part 122 is a lever that restricts the connecting part 151 from moving in the up-down direction by contacting the connecting part 151. The restricting part 122 and adjustment part 160 contribute to a simpler configuration for switching whether the adjustment part 160 is restricted from moving in the up-down direction.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The structures of the sewing machine 1 may be modified as needed. The sewing machine 1 may be an industrial sewing machine. The direction in which the sewing machine 1 conveys the workpiece may be modified as appropriate.

The type, layout, and the like of the presser bar spring 81, adjustment spring 84, and urging member 150 may be modified as appropriate. The presser bar spring 81 and adjustment spring 84 need not both be mounted around the presser bar 8. The configuration of the adjusting mechanism 68 or 200 may be modified as needed. The lower end portion of the adjustment spring 84 need not be accommodated in the housing portion 85. The second length L2 of the adjustment spring 84 in its most compressed state may be greater than the first length L1. The position of the restricting part 67 in the up-down direction may be invariable. In this case, the support part 66 may be omitted from the adjusting mechanism 68, and the sewing machine 1 need not include the changing member 70.

The configuration of the changing member 70 may be modified as needed. The changing member 70 may have a cam surface that guides a contact part fixed to the support part 66. Alternatively, the support part 66 may be provided with a contact part comprising a cam surface, a cam groove, and the like, and the changing member 70 may have a cam that is contacted by the contact part of the support part 66 (a contact-receiving part). The changing member 70 may have a configuration other than the contact part and contact-receiving part, such as a pinion, and a rack fixed to the support part 66 that engages with the pinion. In place of a dial configuration, the changing member 70 may be a lever or the like. The configuration of the restricting member 75 that restricts rotation of the changing member 70 may be modified as needed according to the configuration of the changing member 70. The layout of the changing member 70 relative to the presser bar 8 may also be modified as needed. The changing member 70 is preferably provided in a location that facilitates operations by the user and does not interfere with sewing operations.

The sewing machine 1 may also be provided with a sensor that detects the thickness of the workpiece, and a drive mechanism that rotates the changing member 70 a prescribed amount through the drive force of a motor. The sewing machine 1 may automatically rotate the changing member 70 according to the detection value of the sensor. With this configuration, the sewing machine 1 can help save the user the trouble of operating the changing member 70.

The shape of the adjustment part 65 may be modified as needed. For example, the adjustment part 65 may be shaped as a flat plate, a rectangular parallelepiped, or a sphere, and need not have a crank-like shape. The shape of one or more of the first wall portion 61 through fourth wall portion 64 in the adjustment part 65 may also be modified as needed. Alternatively, one or more of the first wall portion 61 through fourth wall portion 64 in the adjustment part 65 may be omitted as needed. The configuration for changing the position of the restricting part 67 in the up-down direction may be modified as appropriate. The presser bar clamp 82 need not be provided with the housing portion 85, and the second length L2 may be greater than the first length L1.

What is claimed is:

1. A sewing machine comprising:

a sewing machine motor;

a needle bar extending in an up-down direction and having a lower end portion on which a needle is mountable, the needle bar being configured to be driven by the sewing machine motor to move in the up-down direction;

a throat plate formed with a needle hole and an opening, the needle being configured to pass through the needle hole in accordance with movement of the needle bar in the up-down direction;

a feed dog configured to emerge from and be retracted beneath the opening, the feed dog being configured to feed a workpiece placed on the throat plate;

a feed mechanism configured to be driven by the sewing machine motor to drive the feed dog;

a presser bar extending in the up-down direction and having a lower end portion on which a presser foot is mountable, the presser bar being configured to move in the up-down direction in synchronization with movement of the feed dog;

a presser bar spring having an upper end and a lower end in the up-down direction, the presser bar spring being configured to urge the presser bar downward with an urging force;

an adjustment spring having an upper end and a lower end in the up-down direction, the adjustment spring being configured to urge the presser bar downward with an urging force smaller than the urging force of the presser bar spring;

a presser bar clamp fixed to the presser bar, the presser bar clamp being configured to define a position of the lower end of the adjustment spring in the up-down direction; and an adjusting mechanism comprising:

an adjustment part supported to be movable in the up-down direction, the adjustment part being configured to define a position of the lower end of the presser bar spring in the up-down direction and a position of the upper end of the adjustment spring in the up-down direction; and a restricting part configured to restrict a moving range of the adjustment part in the up-down direction when the restricting part contacts the adjustment part, wherein during a first prescribed period of time in which a top of the feed dog is above a top surface of the throat plate, the adjustment part is spaced apart from the restricting part in the up-down direction to cause the urging force of the presser bar spring to be transmitted to the presser foot, and wherein during a second prescribed period of time in which the top of the feed dog is beneath the top surface of the throat plate, the adjustment part is in contact with the restricting part in the up-down direction to prevent the urging force of the presser bar spring from being transmitted to the presser foot.

2. The sewing machine according to claim 1, wherein the adjusting mechanism further comprises:

a support part having a shaft-like shape extending in the up-down direction and having a lower end portion in the up-down direction, the support part being configured to support the adjustment part to be movable in the up-down direction, wherein the restricting part is fixed to the lower end portion of the support part, and wherein the adjustment part has a plate-like shape, the adjustment part having:

a first insertion part through which the support part is inserted; and a second insertion part through which the presser bar is inserted.

3. The sewing machine according to claim 2, wherein the adjustment part comprises:

a first wall portion having the first insertion part, the first wall portion being configured to contact the restricting part to cause the restricting part to define a lower end of the moving range of the adjustment part in the up-down direction;

a second wall portion arranged below the first wall portion, the second wall portion having the second insertion part; and a third wall portion connecting the first wall portion and the second wall portion in the up-down direction, and wherein the first wall portion, the second wall portion, and the third wall portion are arranged to form a crank-like shape.

4. The sewing machine according to claim 3, wherein the adjustment part further comprises:

a fourth wall portion connected to the third wall portion, the fourth wall portion extending in the up-down direction.

5. The sewing machine according to claim 1, wherein the presser bar clamp has a housing portion recessed downward by a first length, the housing portion being configured to accommodate therein the lower end of the adjustment spring, and wherein the adjustment spring has a second length in its most compressed state, the second length being smaller than or equal to the first length.

6. The sewing machine according to claim 1, further comprising:

a changing member configured to change a position of the restricting part in the up-down direction.

7. The sewing machine according to claim 6, wherein the adjusting mechanism further comprises:

a support part having a shaft-like shape extending in the up-down direction and having an upper end portion in the up-down direction, the support part being configured to support the adjustment part to be movable in the up-down direction, the support part having a contact part on the upper end portion, and wherein the changing member has a contact-receiving part configured to contact the contact part, the changing member being configured to change the position of the restricting part in the up-down direction by changing a portion of the contact-receiving part contacting the contact part.

8. The sewing machine according to claim 1, wherein the adjustment part comprises:

a contact part configured to define the position of the lower end of the presser bar spring in the up-down direction and the position of the upper end of the adjustment spring in the up-down direction; and a connecting part movable in the up-down direction together with the contact part, the connecting part being configured to restrict the contact part from moving downward, wherein the adjusting mechanism further comprises:

an urging member configured to urge the connecting part upward, and wherein the restricting part is a lever capable of contacting and separating from the connecting part and configured to restrict the connecting part from moving in the up-down direction by contacting the connecting part.

* * * * *